US006924782B1

(12) United States Patent
Fujioka et al.

(10) Patent No.: US 6,924,782 B1
(45) Date of Patent: Aug. 2, 2005

(54) LIQUID CRYSTAL DISPLAY DEVICE

(75) Inventors: Takahiro Fujioka, Mobara (JP); Kazunari Kurokawa, Mobara (JP); Hiroshi Katayanagi, Chiba (JP); Mitsuru Goto, Chiba (JP); Yukihide Ode, Mobara (JP); Akira Ogura, Nagara-machi (JP); Kentaro Agata, Mobara (JP)

(73) Assignees: Hitachi, Ltd., Tokyo (JP); Hitachi Device Engineering Co., Ltd., Mobara (JP)

( * ) Notice: Subject to any disclaimer, the term of this patent is extended or adjusted under 35 U.S.C. 154(b) by 0 days.

(21) Appl. No.: 09/182,435

(22) Filed: Oct. 30, 1998

(30) Foreign Application Priority Data

Oct. 30, 1997 (JP) ..... 9-298227

(51) Int. Cl.[7] ..... G09G 3/36
(52) U.S. Cl. ..... 345/92; 345/98; 345/100
(58) Field of Search ..... 345/92–100, 204–214; 365/185.18

(56) References Cited

U.S. PATENT DOCUMENTS 4,395,708 A * 7/1983 Lloyd ..... 345/94
5,220,313 A * 6/1993 Kumazawa et al. ..... 345/98
5,682,175 A * 10/1997 Kitamura ..... 345/98
5,748,165 A * 5/1998 Kubota et al. ..... 345/96
5,754,155 A * 5/1998 Kubota et al. ..... 345/98
5,818,406 A * 10/1998 Tsuchi et al. ..... 345/89
5,886,679 A * 3/1999 Matsuda et al. ..... 345/96
5,973,660 A * 10/1999 Hashimoto ..... 345/98
5,995,073 A 11/1999 Isami et al.
6,025,835 A * 2/2000 Aoki et al. ..... 345/204
6,049,321 A * 4/2000 Sasaki ..... 345/99
6,064,362 A * 5/2000 Brownlow et al. ..... 345/98
6,069,605 A * 5/2000 Ozawa ..... 345/98
6,166,725 A 12/2000 Isami et al.
6,181,600 B1 * 1/2001 Seki et al. ..... 365/185.18

* cited by examiner

*Primary Examiner*—Bipin Shalwala
*Assistant Examiner*—David L. Lewis
(74) *Attorney, Agent, or Firm*—Antonelli, Terry, Stout & Kraus, LLP

(57) ABSTRACT

A liquid crystal display device has a semiconductor integrated circuit capable of outputting a voltage equal to or higher than the source-drain withstand voltage of a component transistor. A switching circuit has first conducting-type first and second transistors connected in series between a first input terminal and a common output terminal and second conducting-type third and fourth transistors connected between a second input terminal and the common output terminal and a switching control circuit for controlling the switching circuit. The switching control circuit applies first and second bias voltages for turning on the second and fourth transistors to the gate electrodes of the second and fourth transistors, and applies a control voltage for selectively turning on/off the first or third transistor to the gate electrodes of the first and third transistors.

21 Claims, 23 Drawing Sheets

LPC1
LCT
SHD
HLD1
HLD2
HLD3
HLD4
XXVIB
XXVIA
XXVB
XXVA
A
B
C
CT1
AR
WD
LPC2

LIQUID CRYSTAL DISPLAY DEVICE

BACKGROUND OF THE INVENTION

The present invention relates to a semiconductor integrated circuit and a liquid crystal display device, and particularly to an improvement to be effectively applied to a picture signal line driving circuit (drain driver) of a liquid crystal display device which is capable of displaying many gradations.

An active-matrix liquid crystal display device having an active element (e.g. thin film transistor) for each pixel and which operates by switching the active element is widely used as a display device of a notebook-type personal computer and the like.

Because the active-matrix liquid crystal display device applies a picture signal voltage (a gradation voltage corresponding to display data; hereinafter referred to as a gradation voltage) to a pixel electrode through an active element, no crosstalk is generated between pixels, and so it is unnecessary to use a specific driving method for preventing crosstalk, such as is necessary in a simple matrix liquid crystal display device, thereby making it possible to display many gradations.

As an active-matrix liquid crystal display device, the following devices are known: a TFT (thin film transistor)-type liquid crystal display panel (TFT-LCD) and a TFT-type liquid crystal display module provided with a drain driver set to the upper side of a liquid crystal display panel, a gate driver set to the lateral side of the liquid crystal display panel, and an interface section.

In general, when the same voltage level (DC voltage) is applied to a liquid crystal layer for a long time, the inclination of the liquid crystal layer becomes fixed, causing an afterimage phenomenon, which operates to shorten the service life of the liquid crystal layer.

To prevent the afterimage phenomenon, in the case of a TFT-type liquid crystal module, the voltage to be applied to a liquid crystal layer is changed to a periodically changing voltage like an AC voltage, that is, the voltage to be applied to a pixel electrode is changed between a positive voltage and a negative voltage periodically in accordance with the voltage to be applied to a common electrode.

To apply an AC type voltage to the liquid crystal layer, the following two methods are known: the common symmetry method and the common inversion method. The common inversion method is a method wherein the voltage to be applied to a common electrode and the voltage to be applied to a pixel electrode are alternately changed between a positive voltage and a negative voltage. On the other hand, the common symmetry method is a method wherein the voltage to be applied to a common electrode is kept constant and the voltage to be applied to a pixel electrode is alternately changed between a positive voltage and a negative voltage relative to the voltage to be applied to the common electrode.

According to the common symmetry method, it is possible to use the dot inversion method or the V-line inversion method, which provides a small power consumption and a superior display quality.

The above-described technology is disclosed in U.S. patent application Ser. No. 08/826,973 filed on Apr. 9, 1997, now U.S. Pat. No. 5,995,073.

In the case of the dot inversion method, as shown in FIG. 30, the gradation voltage (VDH) to be applied to the odd-numbered drain signal line (D) and the gradation voltage (VDL) to be applied to the even-numbered drain signal line (D) have opposite polarities relative to the driving voltage (VCOM) to be applied to a common electrode. That is, when the gradation voltage (VDH) to be applied to the odd-numbered drain signal line (D) has a positive polarity (or negative polarity), the gradation voltage (VDL) to be applied to the even-numbered drain signal line (D) has a negative polarity (or positive polarity). Moreover, the polarity is inverted for each line and the polarity for each line is inverted for each frame.

FIG. 30 is a signal diagram showing the relation between the gradation voltage to be applied to a drain signal line (D), that is, the voltage to be applied to a pixel electrode and the driving voltage (VCOM) to be applied to a common electrode. The gradation voltage to be applied to a drain signal line (D) shown in FIG. 30 is for displaying black on the display screen of a liquid crystal display panel.

Thus, the dot inversion method has a disadvantage in that the chip size of a drain driver increases because a circuit for generating positive- and negative-polarity gradation voltages is necessary for each drain signal line (D).

To avoid the above-described disadvantage, in the case of the TFT-type liquid crystal display module disclosed in U.S. patent application Ser. No. 08/826,973 filed on Apr. 9, 1997, now U.S. Pat. No. 5,995,073, the chip size of a drain driver is decreased by using the fact that the polarity of the gradation voltage (VDH) to be outputted to the odd-numbered drain signal line (D) is always opposite to that of the gradation voltage (VDL) to be outputted to the even-numbered drain signal line (D) in the case of the dot inversion method, thereby making it possible to share a circuit for generating positive- and negative-polarity gradation voltages for two drain signal lines (D) by switching the circuit using a switching section, resulting in reduction of the chip size.

However, the TFT-type liquid crystal display module disclosed in U.S. patent application Ser. No. 08/826,973 filed on Apr. 9, 1997, now U.S. Pat. No. 5,995,073, has a problem in that a transistor having a higher withstand voltage between source and drain is necessary as the switching transistor of the switching section, thereby increasing the chip size of the drain driver, when it is necessary to increase the gradation voltages (VDH and VDL) to be applied to a drain signal line (D), compared to those of a conventional TFT-type liquid crystal display module, due to change of the materials of the liquid crystal layer.

In the case of a liquid crystal display, such as a TFT-type liquid crystal display module, the display screen has been increased in size, and the tendency is for the display screen size to even further increase. Moreover, to eliminate unnecessary space and improve the fine view provided by a display, it has been proposed to decrease the region outside of the display region of a liquid crystal display, that is, minimize the frame portion (frame minimization).

However, when the chip size of a semiconductor integrated circuit (IC chip) constituting the drain driver increases by using a transistor having a higher withstand voltage between source and drain as the switching transistor of the switching section, a problem occurs in that it is impossible to deal with the requirements for frame minimization.

The present invention has been made to solve the above problems, and its object is to make it possible to use a transistor with a low withstand voltage for a semiconductor integrated circuit operating as the switching element of a switching circuit in which a voltage higher than the normal withstand voltage between the source and drain of the transistor with low withstand voltage is applied between input and output terminals.

It is another object of the present invention to make it possible to use a transistor with a low withstand voltage for a liquid crystal display operating as the switching element of a switching section in which a voltage higher than the normal withstand voltage between the source and the drain of the transistor with low withstand voltage and output positive- and negative-polarity picture signal voltages to a pair of picture signal lines without increasing the chip size of the picture signal line driving means.

The above objects and novel features of the present invention will become more apparent from the following description and the accompanying drawings.

SUMMARY OF THE INVENTION

The outline of typical examples of the features disclosed in the present application will be briefly described below.

A liquid crystal display is provided with a liquid crystal display panel and a picture signal line driving circuit for supplying a picture signal voltage to the liquid crystal display panel, wherein the picture signal driving circuit has:

a switching circuit constituted by connecting in series a first transistor in which a control voltage is applied to a gate electrode thereof and a second transistor in which a bias voltage is applied to a gate electrode thereof.

A liquid crystal display is provided with a liquid crystal display panel and a picture signal driving circuit for supplying a picture signal voltage to the liquid crystal display panel, wherein the picture signal driving circuit has:

a first input terminal, a second input terminal, and a common output terminal, a first switching element connected between the first input terminal and the common output terminal, and a second switching element connected between the second input terminal and the common output terminal, and moreover wherein the first and the second switching elements respectively include an input-terminal-side transistor in which a control voltage is applied to a gate electrode connected in series with an output-terminal-side transistor in which a bias voltage is applied to a gate electrode.

A liquid crystal display is constituted by a liquid crystal display panel and a picture signal driving circuit for supplying a picture signal voltage to the liquid crystal display panel, wherein the picture signal driving circuit has:

a first output circuit for outputting a positive-polarity picture signal voltage, a second output circuit for outputting a negative-polarity picture signal voltage, and a switching circuit for outputting the positive-polarity picture signal voltage received from the first output circuit and the negative-polarity picture signal voltage received from the second output circuit by switching the voltages to a pair of picture signal lines, and, moreover, wherein the switching circuit has:

a first switching element connected between the first output circuit and the first picture signal line of a pair of picture signal lines, a third switching element connected between the first output circuit and the second picture signal line of a pair of picture signal lines, a second switching element connected between the second output circuit and the second picture signal line, and a fourth switching element connected between the second output circuit and the first picture signal line, and, moreover, the switching circuit:

outputs the positive-polarity picture signal voltage received from the first output circuit to the first picture signal line or the second picture signal line by selectively turning on/off the first switching element, the second switching element, the third switching element, and the fourth switching element, and selectively outputs the negative-polarity picture signal voltage received from the second output circuit to the second picture signal line or the first picture signal line.

The switching elements are constituted by connecting an output-circuit-side transistor, in which a control voltage is applied to a gate electrode, in series with a picture-signal-line-side transistor, in which a constant bias voltage is applied to a gate electrode.

DETAILED DESCRIPTION OF THE INVENTION

An embodiment of the present invention will be described below with reference to the accompanying drawings.

In all of the drawings for explaining the various embodiments of the present invention, components having the same function are provided with the same symbol and their repetitive description is omitted.

Figure 1:
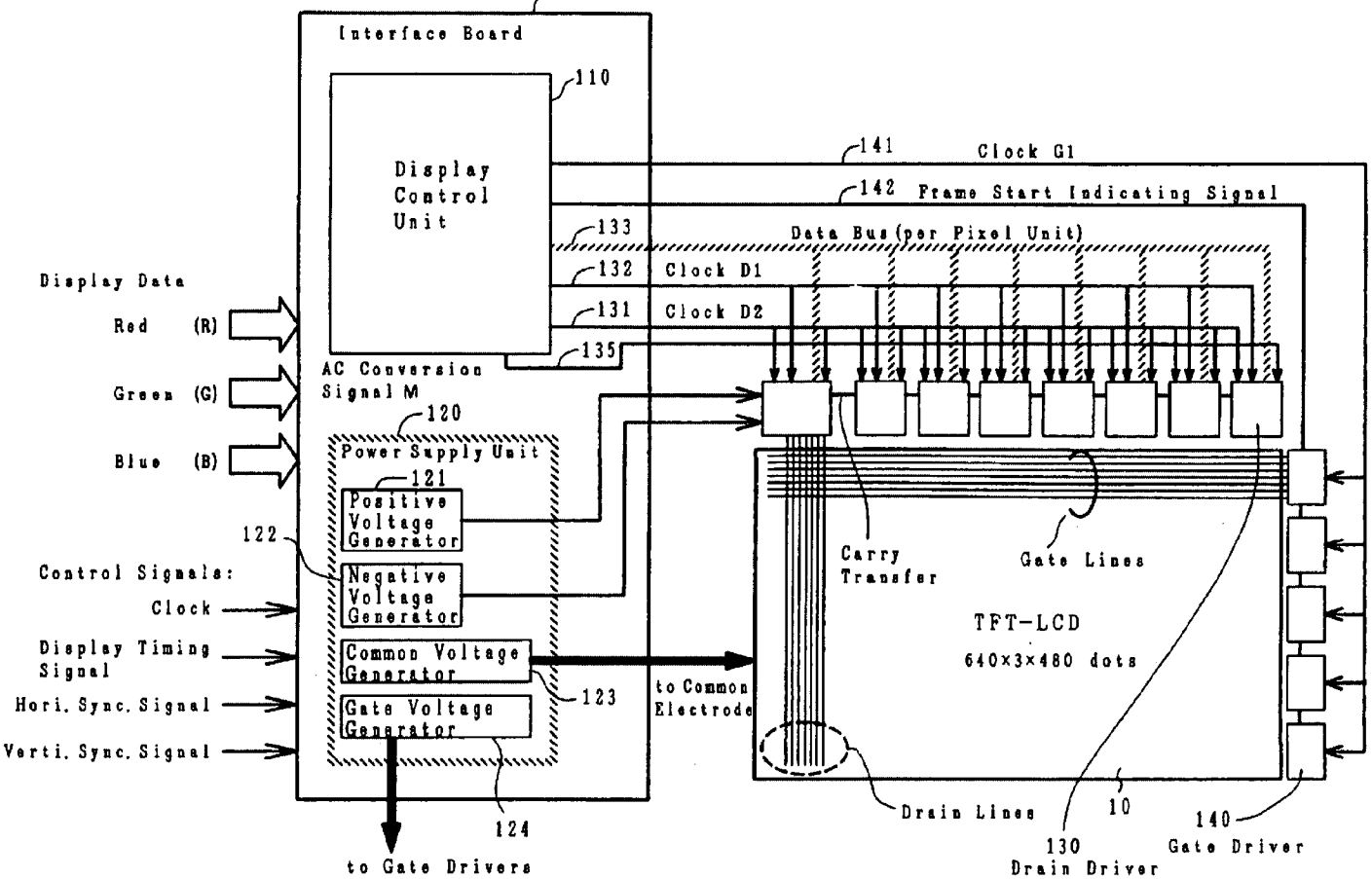
FIG. 1 is a block diagram showing an example of a TFT-type liquid crystal display module representing an embodiment of the present invention.

FIG. 1 is a block diagram showing a TFT-type liquid crystal display module representing an embodiment of the present invention.

In the liquid crystal display module (LCM) of the present invention, a drain driver 130 is set to the upper side of a liquid crystal display panel (TFT-LCD) 10 and a gate driver 140 and an interface section 100 are arranged at respective sides of the liquid crystal display panel 10.

The interface section 100 is mounted on an interface board and the drain driver 130 and the gate driver 140 are also each mounted on their own printed circuit board.

Figure 2:
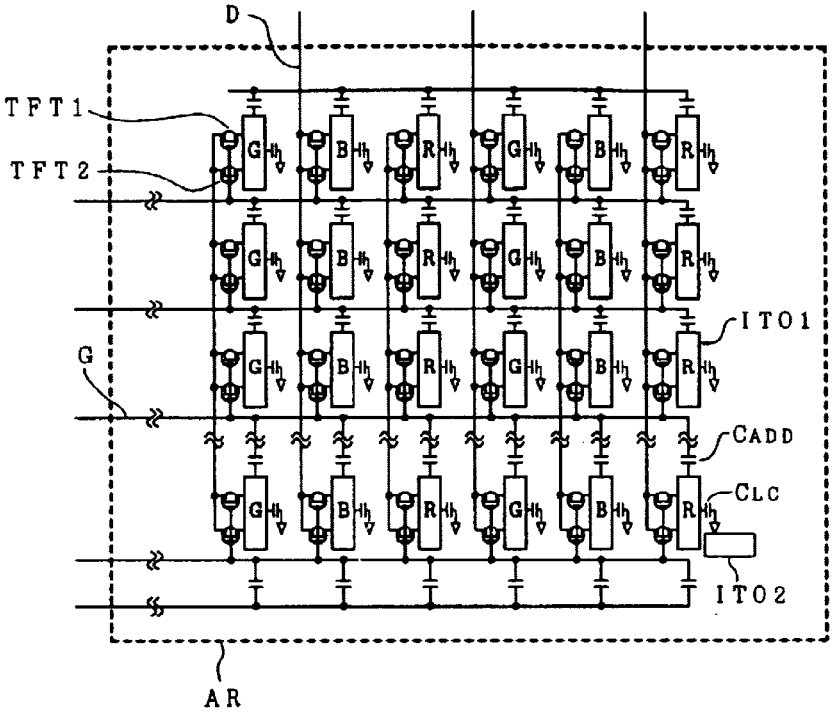
FIG. 2 is a schematic circuit diagram showing the equivalent circuit of an example of the liquid crystal display panel shown in FIG. 1.

FIG. 2 is an illustration showing an example of the equivalent circuit of the liquid crystal display panel 10 shown in FIG. 1. As shown in FIG. 2, the liquid crystal display panel 10 has a plurality of pixels arranged in the form of a matrix.

Each pixel is arranged in an intersectional region formed between two adjacent signal lines {drain signal lines (D) or gate signal lines (G)} and two adjacent signal lines {gate signal lines (G) or drain signal lines (D)}.

Each pixel has thin-film transistors (TFT1 and TFT2), and the source electrodes of the thin-film transistors (TFT1 and TFT2) of each pixel are connected to a pixel electrode (ITO1). Moreover, because a liquid crystal layer (LC) is formed between the pixel electrode (ITO1) and the common electrode (ITO2), a liquid crystal capacitance is equivalently connected between the pixel electrode (ITO1) and the common electrode (ITO2).

Furthermore, an additional capacitance (CADD) is connected between the source electrodes of the thin-film transistors (TFT1 and TFT2) on one hand and the front-stage gate signal line (G) on the other.

Figure 3:
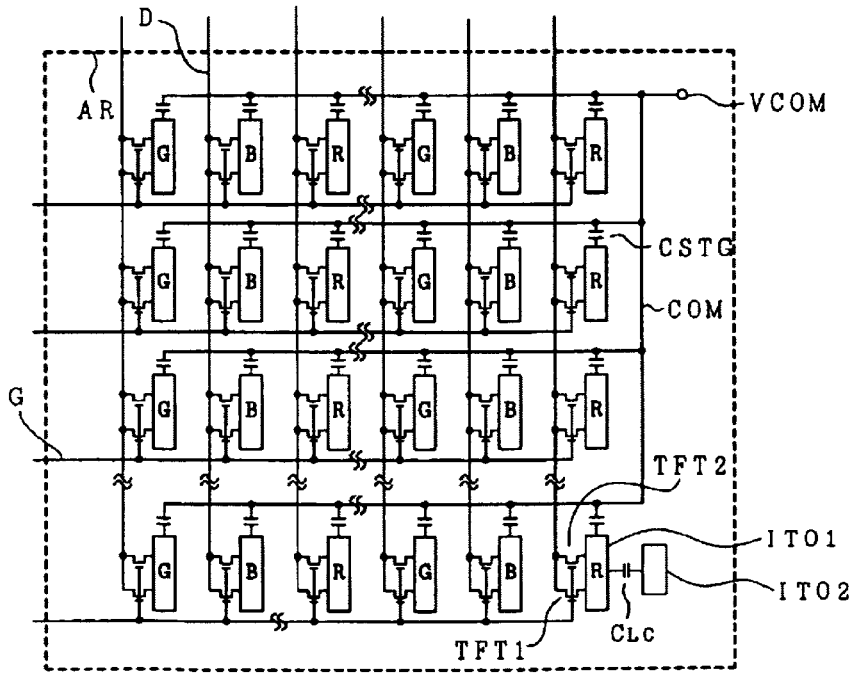
FIG. 3 is a schematic circuit diagram showing the equivalent circuit of another example of the liquid crystal display panel shown in FIG. 1.

FIG. 3 is an illustration showing the equivalent circuit of another example of the liquid crystal display panel 10.

In the case of the example shown in FIG. 2, an additional capacitance (CADD) is formed between the gate signal lines (G) and the source electrodes at all stages. However, the equivalent circuit of the example shown in FIG. 3 is different in that a holding capacitance (CSTG) is formed between a common signal line (COM) and a source electrode.

The present invention can be applied to both of the above systems. In the case of the former system, pulses of gate signal lines (G) at all stages enter the pixel electrode (ITO1) through the additional capacitance (CADD). In the case of the latter system, however, a better display is realized because no pulse enters a pixel electrode.

Figure 4:
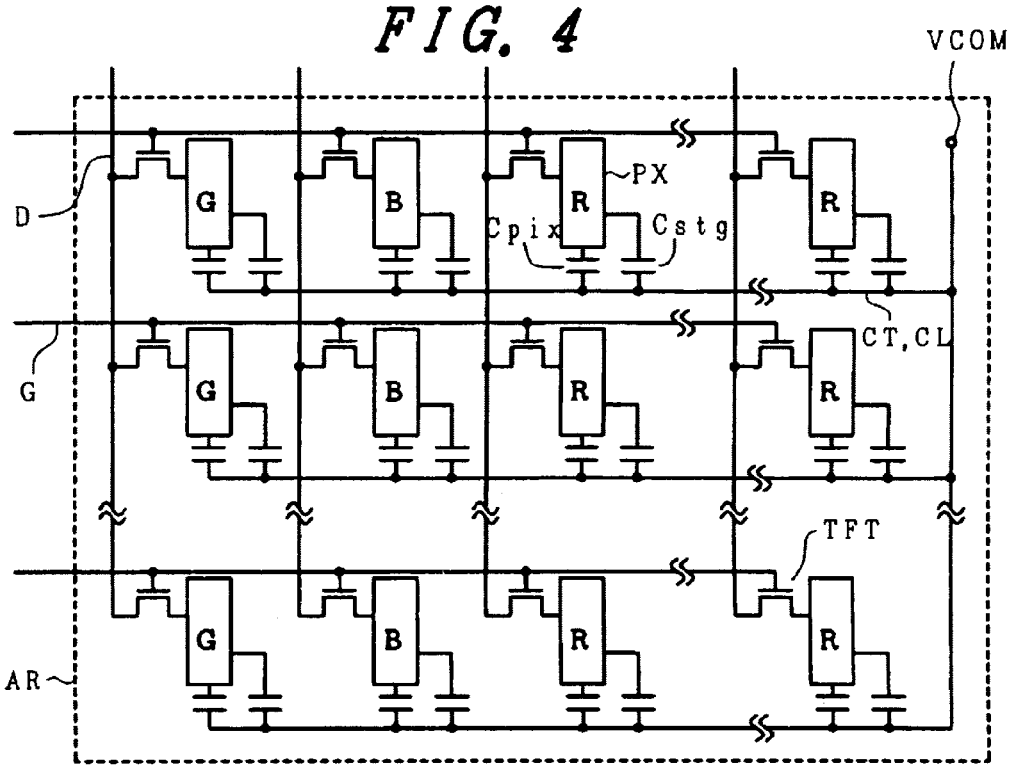
FIG. 4 is a schematic circuit diagram showing the equivalent circuit of still another example of the liquid crystal display panel shown in FIG. 1.

FIGS. 2 and 3 show equivalent circuits of longitudinal electric-field liquid crystal display panels. Moreover, FIGS. 2 and 3 are circuit diagrams drawn to correspond to an actual geometric arrangement. FIG. 4 shows the equivalent circuit of another example of the liquid crystal display panel 10. Moreover, the equivalent circuit of FIG. 4 is that of a lateral electric-field liquid crystal display panel.

In the case of the longitudinal electric-field liquid crystal display panel shown in FIG. 2 or FIG. 3, the common electrode (ITO2) is formed on a color filter board. In the case of the lateral electric-field liquid crystal display panel of FIG. 4, however, a facing electrode (CT) is provided for a TFT board and a facing-electrode signal line (CL) for applying a driving voltage (VCOM) is provided for the facing electrode (CT).

Therefore, a liquid crystal capacitance (Cpix) is equivalently connected between a pixel electrode (PX) and the facing electrode (CT). Moreover, an accumulation capacitance (Cstg) is formed between the pixel electrode (PX) and the facing electrode (CT).

In FIGS. 2, 3, and 4, symbol AR denotes a display region. In the liquid crystal display panels 10 shown in FIGS. 2 to 4, the drain electrode of the thin-film transistor (TFT) of each pixel is connected to each drain signal line (D) and each drain signal line (D) is connected to the drain driver 130 for applying a gradation voltage to the liquid crystal of each pixel in the column direction.

Moreover, the gate electrode of the thin-film transistor (TFT) of each pixel arranged in the row direction is connected to each gate signal line (G), and each gate signal line (G) is connected to the gate driver 140 for supplying a scan driving voltage (positive bias voltage or negative bias voltage) to the gate electrode of the thin-film transistor (TFT) of each pixel in the row direction for one horizontal scanning period.

The interface section 100 shown in FIG. 1 is constituted by a display controller 110 and a power supply circuit 120.

The display controller 110 is formed by a single semiconductor integrated circuit (LSI) which controls and drives the drain driver 130 and the gate driver 140 in accordance with a display control signal, such as a clock signal, display timing signal, horizontal sync signal, or vertical sync signal transmitted from the computer, and display data (R,G,B).

When the display controller 110 receives a display timing signal, it recognizes the signal as identifying a display start position and outputs the received display data of a single column to the drain driver 130 through a display-data bus line 133.

In this case, the display controller 110 outputs a display-data latching clock (D2), serving as a display control signal for latching display data to the data latching circuit of the drain driver 130, through a signal line 131.

The display data sent from the computer is 8 bits and is transferred in pixels, that is, for every unit time, by forming data values for red (R), green (G), and blue (B) into a set.

When the input of a display timing signal is completed or a predetermined time passes after the display timing signal is inputted, the display controller 110 decides that the display data for one horizontal period is completed and outputs an output-timing control clock (D1), serving as a display control signal for outputting the display data stored in the latching circuit of the drain driver 130 to the drain signal line (D) of the liquid crystal display panel 10, to the drain driver 130 through a signal line 132.

Moreover, when the display controller 110 receives a first display timing signal after receiving a vertical sync signal, it recognizes the timing signal as indicating a first display line and outputs a frame start designation signal to the gate driver 140 through a signal line 142.

Furthermore, the display controller 110 outputs a clock (G1) serving as a shift clock to the gate driver 140 through a signal line 141 every horizontal scanning period so as to successively apply a positive bias voltage to each gate signal line (G) of the liquid crystal display panel 10 every horizontal scanning period.

Thereby, a plurality of thin-film transistors (TFTs) connected to each gate signal line (G) of the liquid crystal display panel 10 are turned on for one horizontal scanning period.

According to the above operations, an image is displayed on the liquid crystal display panel 10.

The power supply circuit 120 shown in FIG. 1 is constituted with a positive-voltage generation circuit 121, a negative-voltage generation circuit 122, a common electrode (facing electrode) voltage generation circuit 123, and a gate electrode voltage generation circuit 124.

The positive-voltage generation circuit 121 and negative-voltage generation circuit 122 are respectively constituted by a series-resistance voltage division circuit. The positive-voltage generation circuit 121 outputs five positive-polarity gradation reference voltages (V"0 to V"4) and the negative voltage generation circuit 122 outputs five negative-polarity gradation reference voltages (V"5 to V"9).

The positive-polarity gradation reference voltages (V"0 to V"4) and the negative-polarity gradation reference voltages (V"5 to V"9) are supplied to each drain driver 130.

Moreover, a conversion-to-AC signal (conversion-to-AC timing signal; M) is also supplied to each drain driver 130 from the display controller 110 through a signal line 135.

The common-electrode voltage generation circuit 123 generates a driving voltage to be applied to the common electrode (ITO2) {or the facing electrode (CT)} and the gate-electrode voltage generation circuit 124 generates driving voltages (positive bias voltage and negative bias voltage) to be applied to the gate electrode of a thin-film transistor (TFT).

As described above, two methods, such as the common symmetry method and the common inversion method, are known driving methods for applying an AC type voltage to a liquid crystal layer. In the case of the common symmetry method, the amplitude of a voltage to be applied to the pixel electrode (ITO1/PX) is two times larger than the case of the common inversion method, and, therefore, there is a disadvantage in that a low withstand voltage driver cannot be used. However, the dot inversion method or V-line inversion method can be used, which has a small power consumption and a superior display quality.

The liquid crystal display module of this embodiment of the present invention uses the dot inversion method as its driving method.

By using the dot inversion method, voltages to be applied to adjacent drain signal lines (D) have polarities opposite to each other. Therefore, it is possible to reduce the power consumption because the current flowing through the common electrode (ITO2) {or facing electrode (CT)} and the current flowing through the gate electrode of a thin-film transistor (TFT) are offset relative to each other.

Moreover, because the current flowing through the common electrode (ITO2) {or facing electrode (CT)} is small, the voltage drop is suppressed. Therefore, the voltage level of the common electrode (ITO2) {or facing electrode (CT)} is stabilized and it is possible to minimize deterioration of the display quality.

Figure 5:
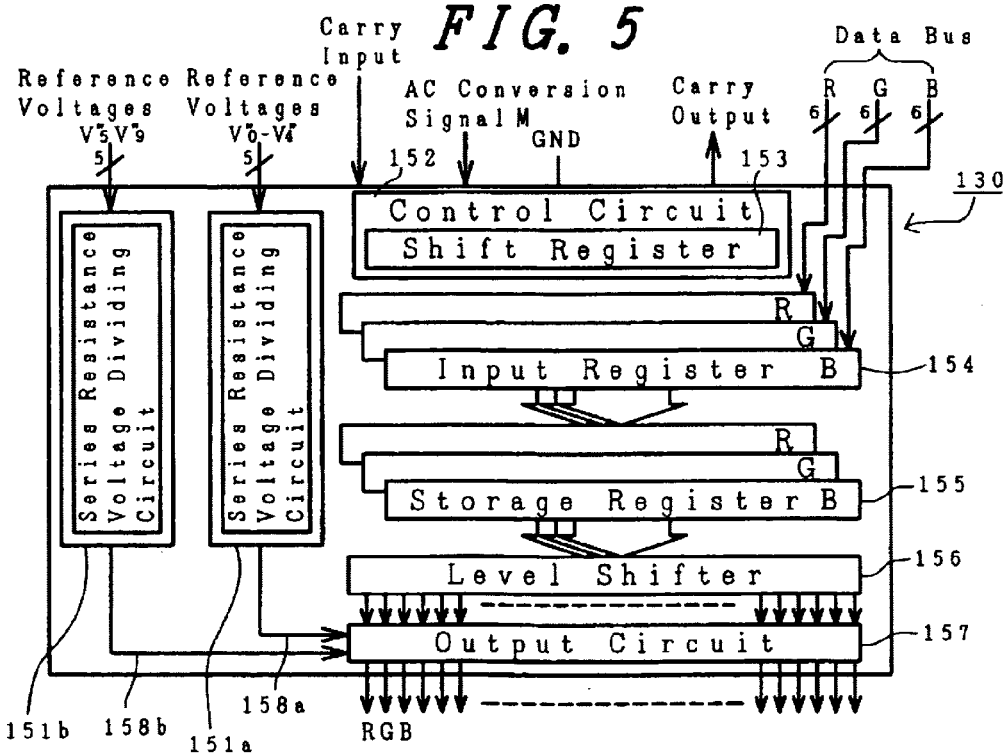
FIG. 5 is a block diagram showing an example of the drain driver shown in FIG. 1.

FIG. 5 is a block diagram showing an example of the drain driver 130 shown in FIG. 1.

The drain driver 130 is constituted with one semiconductor integrated circuit (LSI).

In FIG. 5, a positive-polarity gradation voltage generation circuit 151*a* generates first positive-polarity gradation voltages of 33 gradations in accordance with five positive-polarity gradation reference voltages (V"0 to V"4) inputted from the positive-voltage generation circuit 121 and outputs the voltages to an output circuit 157 through a voltage bus line 158*a*. A negative-polarity gradation voltage generation circuit 151*b* generates first negative-polarity gradation voltages of 33 gradations in accordance with five negative-polarity gradation reference voltages (V"5 to V"9) inputted from the negative-voltage generation circuit 122 and outputs the voltages to the output circuit 157 through a voltage bus line 158*b*.

Moreover, a shift register circuit 153 in a control circuit 152 of the drain driver 130 generates a signal for fetching data from an input register circuit 154 in accordance with the display data latching clock (D2) received from the display controller 110 and outputs the signal to the input register circuit 154.

The input register circuit 154 latches the display data of 8 bits for each color by the value equivalent to the number of outputs synchronously with the display-data latching clock (D2) received from the display controller 110 in accordance with the data-capturing signal output from the shift register circuit 153.

A storage register circuit 155 latches the display data received from the input register circuit 154 in response to the output-timing control clock (D1) received from the display controller 110.

The display data fetched by the storage register circuit 155 is inputted to the circuit 157 through a level shift circuit 156.

The output circuit 157 generates one gradation voltage (one of 256 gradation voltages) corresponding to display data in accordance with the first positive-polarity gradation voltages of 33 gradations or first negative-polarity gradation voltages of 33 gradations and outputs the gradation voltage to each drain signal line (D).

Figure 6:
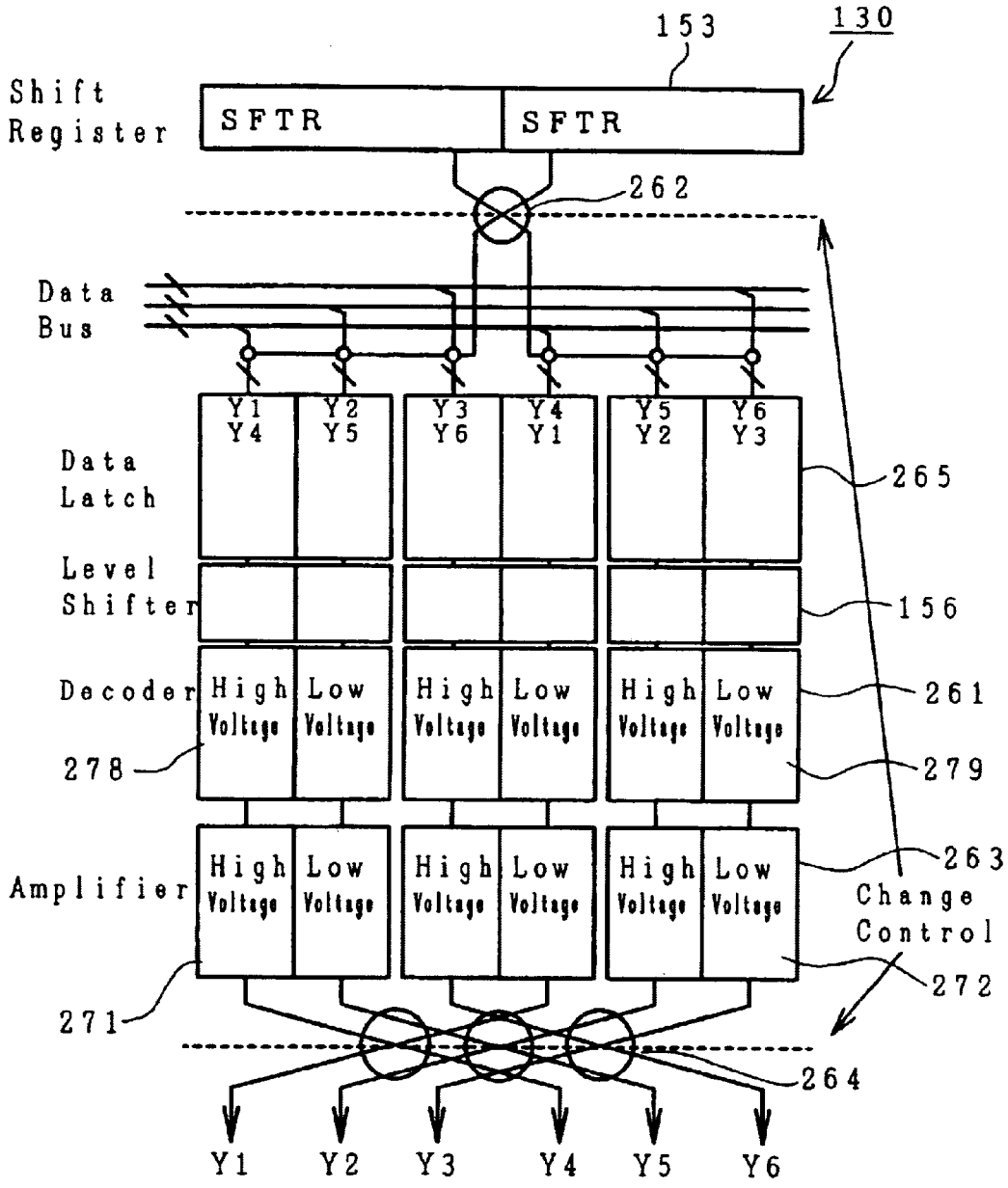
FIG. 6 is a block diagram for explaining the structure of the drain driver shown in FIG. 5, centering around the structure of an output circuit.

FIG. 6 is a block diagram for explaining the structure of the drain driver 130 shown in FIG. 5, centering around the structure of the output circuit 157.

In FIG. 6, symbol 153 denotes a shift register circuit in the control circuit 152 shown in FIG. 5 and 156 denotes a level shift circuit shown in FIG. 5. Moreover, a data latching circuit 265 shows the input register circuit 154 and storage register circuit 155 shown in FIG. 5. Furthermore, a decoder section (gradation voltage selection circuit) 261, an amplifier circuit pair 263, and a switching section (2) 264 for switching the outputs of the amplifier circuit pair 263 constitute the output circuit 157 shown in FIG. 5.

In this case, a switching section (1) 262 and the switching section (2) 264 are controlled in accordance with a conversion-to-AC signal (M).

Moreover, Y1, Y2, Y3, Y4, Y5, and Y6 indicate first, second, third, fourth, fifth, and sixth drain signal lines (D).

The drain driver 130 shown in FIG. 6 switches data-fetching signals inputted to the data latching section 265 (more particularly, the input register 154 shown in FIG. 5) by the switching section (1) 262 and inputs the display data for each color to the adjacent data-latching sections 265 for each color.

The decoder section 261 is constituted by a high-voltage decoder circuit 278 for generating positive-polarity gradation voltages corresponding to the display data output from each data latching section 265 (more particularly, the storage register 155 shown in FIG. 5) in accordance with the first positive-polarity gradation voltages of 33 gradations output from the gradation-voltage generation circuit 151*a* through the voltage bus line 158*a* and a low-voltage decoder circuit 279 for generating negative-polarity gradation voltages corresponding to the display data outputted from each data latching section 265 in accordance with the first negative-polarity gradation voltages of 33 gradations outputted from the gradation voltage generation circuit 151*b* through the voltage bus line 158*b*.

The high-voltage decoder circuit 278 and the low-voltage decoder circuit 279 are provided for each adjacent data latching section 265.

The amplifier circuit pair 263 is constituted by a high-voltage amplifier circuit 271 and a low-voltage amplifier circuit 272. The high-voltage amplifier circuit 271 receives a positive-polarity gradation voltage generated by the high-voltage decoder circuit 278 and outputs a positive-polarity gradation voltage. The low-voltage amplifier circuit 272 receives a negative-polarity gradation voltage generated by the low-voltage decoder circuit 279 and outputs a negative-polarity gradation voltage.

In the case of the dot inversion method, gradation voltages for adjacent colors have polarities opposite to each other and the high-voltage amplifier circuit 271 and the low-voltage amplifier circuit 272 of the amplifier circuit pair 263 are arranged in the sequence of the high-voltage amplifier circuit 271, low-voltage amplifier circuit 272, high-voltage amplifier circuit 271, and low-voltage amplifier circuit 272. Therefore, it is possible to output a positive-polarity or negative-polarity gradation voltage by switching data-fetching signals inputted to the data latching section 165 by the switching section (1) 262, inputting the display data for each color to adjacent data latching sections 265 for each color, thereby switching the voltages outputted from the high-voltage amplifier circuit 271 or low-voltage amplifier circuit 272 by the switching section (2) 264 and outputting the voltages to drain signal lines (D), such as the first drain signal line (Y1) and the fourth drain signal line (Y4), from which gradation voltages for various colors are outputted.

Figure 7:
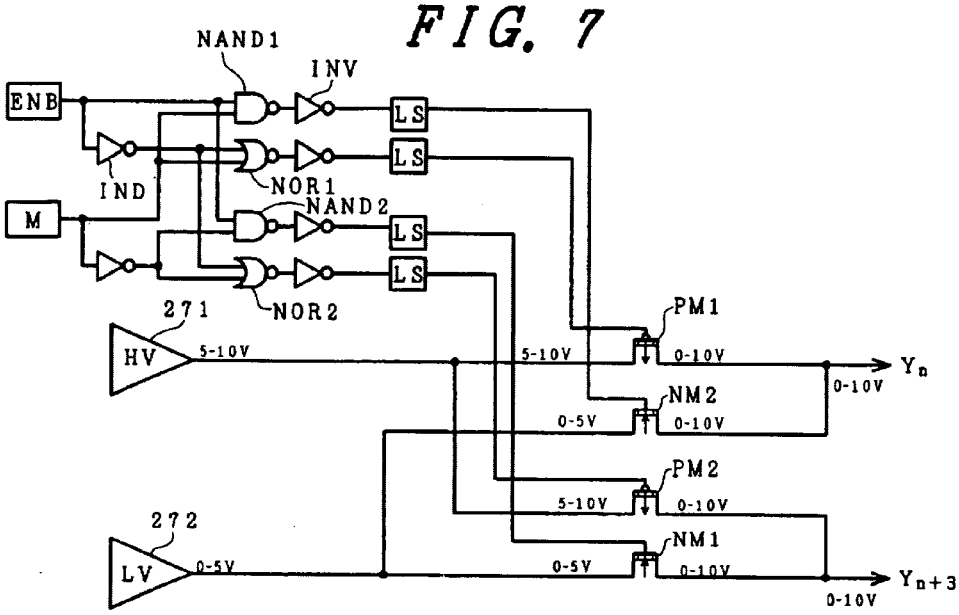
FIG. 7 is a schematic circuit diagram of a switching circuit of the switching section of a conventional device.

FIG. 7 is a circuit diagram showing an example of the structure of a conventional switching circuit for use in the switching section (2) 264.

As shown in FIG. 7, the switching circuit of the switching section (2) 264 has a PMOS transistor (PM1) connected between the high-voltage amplifier circuit 271 and the n-th drain signal line (Yn), a PMOS transistor (PM2) connected between the high-voltage amplifier circuit 271 and the (n+3)-th drain signal line (Yn+3), an NMOS transistor (NM1) connected between the low-voltage amplifier circuit 272 and the (n+3)-th drain signal line (Yn+3), and an NMOS transistor (NM2) connected between the low-voltage amplifier circuit 272 and the n-th drain signal line (Yn).

The output of a NOR circuit (NOR1) inverted by an inverter (INV) is level-shifted by a level shift circuit (LS) and inputted to the gate electrode of the PMOS transistor (PM1) and the output of a NOR circuit (NOR2) inverted by the inverter (INV) is level-shifted by the level shift circuit (LS) and inputted to the gate electrode of the PMOS transistor (PM2).

Similarly, the output of the NAND circuit (NAND2) inverted by the inverter (INV) is level-shifted by the level shift circuit (LS) and inputted to the gate electrode of the NMOS transistor (NM1) and the output of the NAND circuit (NAND1) inverted by the inverter (INV) is level-shifted by the level shift circuit (LS) and inputted to the gate electrode of the NMOS transistor (NM2).

Moreover, in FIG. 7, voltages to be applied to the MOS transistors (PM1, PM2, NM1, and NM2) are combined as illustrated.

In this case, a conversion-to-AC signal (M) is inputted to a NAND circuit (NAND1) and the NOR circuit (NOR1), and a conversion-to-AC signal (M) inverted by the inverter (INV) is inputted to the NAND circuit (NAND2) and the NOR circuit (NOR2).

Moreover, an output enable signal (ENB) is inputted to the NAND circuits (NAND1 and NAND2) and an output enable signal (ENB) inverted by the inverter (INV) is inputted to the NOR circuits (NOR1 and NOR2).

Table 1 shows a truth table for the NAND circuits (NAND1 and NAND2) and the NOR circuits (NOR1 and NOR2) and the following on/off states of the MOS transistors (PM1, PM2, NM1, and NM2).

TABLE 1

| ENB | M | NOR1 | PM1 | NAND2 | NM1 | NAND1 | PM2 | NOR2 | NM2 |
|---|---|---|---|---|---|---|---|---|---|
| L | * | L | OFF | H | OFF | H | OFF | L | OFF |
| H | H | L | OFF | H | OFF | L | ON | H | ON |
| | L | H | ON | L | ON | H | OFF | L | OFF |

Symbol * denotes that there is no relation with a conversion-to-AC signal (M).

As shown in Table 1, when an output enable signal (ENB) is Low-level (hereinafter referred to as L-level), the NAND circuits (NAND1 and NAND2) become High-level (hereinafter referred to as H-level), the NOR circuits (NOR1 and NOR2) become L-level, and the MOS transistors (PM1, PM2, NM1, and NM2) are turned off.

When scanning lines are switched, the high-voltage amplifier circuit 271 and the low-voltage amplifier circuit 272 are in an unstable state.

The output enable signal (ENB) is used to prevent the output of each of the amplifier circuits (271 and 272) from being outputted to each drain signal line (D) while scanning lines are switched.

Moreover, as shown in Table 1, when the output enable signal (ENB) is H-level, the NAND circuits (NAND1 and NAND2) become H-level or L-level and the NOR circuit (NOR1) becomes H-level or L-level according to the H-level or L-level of the conversion-to-AC signal (M).

As a result, the PMOS transistor (PM1) and NMOS transistor (NM1) are turned off or on, the PMOS transistor (PM2) and NMOS transistor (NM2) are turned on or off, and the output of the high-voltage amplifier circuit 271 is outputted to the drain signal line (Yn+3), and that of the low-voltage amplifier circuit 272 is outputted to the drain signal line (Yn), or the output of the high-voltage amplifier circuit 271 is outputted to the drain signal line (Yn), and that of the low-voltage amplifier circuit 272 is outputted to the drain signal line (Yn+3).

In the case of the conventional liquid crystal display module (LCM), the gradation voltage to be applied to the liquid crystal layer (LC) of each pixel ranges between 0 and 5 V at the negative-polarity side and between 5 and 10 V at the positive-polarity side. Therefore, a negative-polarity gradation voltage of 0 to 5 V is outputted from the low-voltage amplifier circuit 272 and a positive-polarity gradation voltage of 5 to 10 V is outputted from the high-voltage amplifier circuit 271.

In this case, when the PMOS transistor (PM1) is turned off and the NMOS transistor (NM2) is turned on, a voltage of up to 10 V is applied between the source and the drain of the PMOS transistor (PM1).

Therefore, the MOS transistors (PM1, PM2, NM1, and NM2) respectively use a MOS transistor with a high withstand voltage, having a source-drain withstand voltage of 10 V.

Because the gap length between a pixel electrode (PX) and a facing electrode (CT) has been increased or the liquid crystal material of a liquid crystal layer (LC) has been improved in accordance with the improvement in resolution of the lateral electric-field-type liquid crystal display panel, it is necessary to increase the range of the gradation voltage to be applied to the liquid crystal layer (LC) of each pixel to −5 to 2.5 V at the negative-polarity side and 2.5 to 10 V at the positive-polarity side.

When applying gradation voltages having a range of −5 to 2.5 V at the negative-polarity side and a range of 2.5 to 10 V at the positive-polarity side to the liquid crystal layer (LC) of each pixel, a voltage of up to 15 V is applied to the MOS transistors to be turned off in the switching circuit shown in FIG. 7. Therefore, it is necessary to use a MOS transistor with a high withstand voltage having a source-drain withstand voltage of 15 V for the MOS transistors (PM1, PM2, NM1, and NM2) constituting the switching circuit.

A MOS transistor with a high withstand voltage, for example, having a source-drain withstand voltage of 15 V, has a large fluctuation of threshold (VT) or conductance (gm). Moreover, it is necessary to replace every MOS transistor with high withstand voltage in the drain driver 130 with a MOS transistor with a high withstand voltage having a source-drain withstand voltage of 15 V due to the restriction on the fabrication process. Therefore, a problem occurs that the chip size of a semiconductor integrated circuit constituting the drain driver 130 increases, and thus, it is impossible to accomplish adequate frame minimization.

Figure 8:
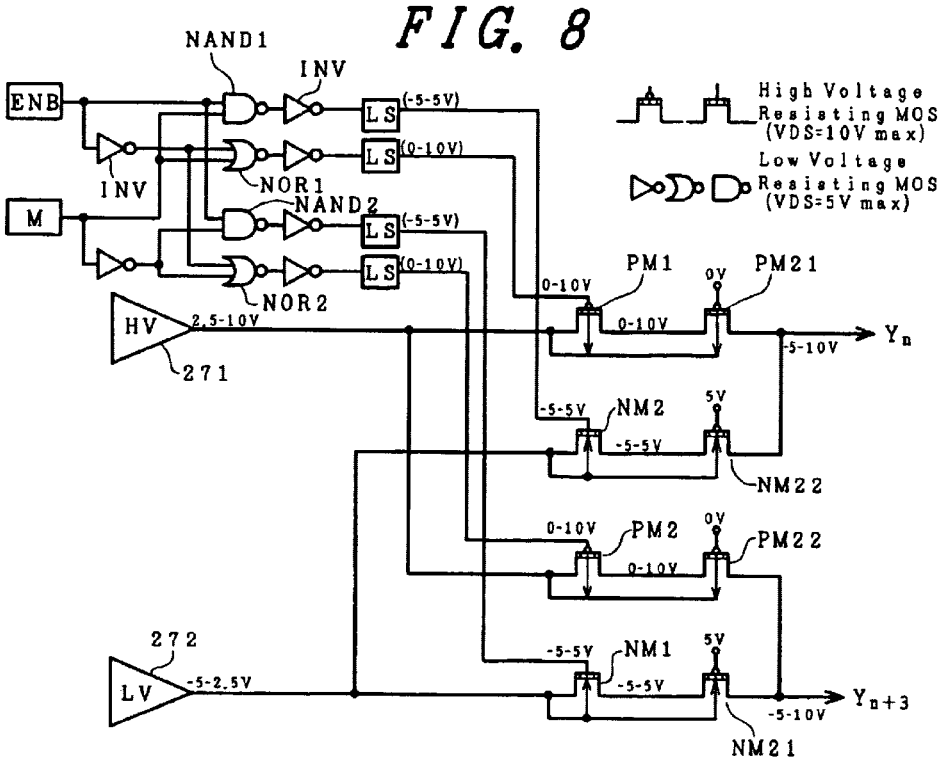
FIG. 8 is a schematic circuit diagram of a switching circuit of the switching section representing an embodiment of the present invention.

FIG. 8 is a circuit diagram showing the structure of a switching circuit of the switching section (2) 264 representing an embodiment of the present invention.

In the case of the present invention, a gradation voltage having a range of 2.5 to 10 V is outputted from the high-voltage amplifier circuit 271 and a gradation voltage having a range of −5 to 2.5 V is outputted from the low-voltage amplifier circuit 272. Therefore, voltage-dropping MOS transistors (PM21, PM22, NM21, and NM22) are connected in series with the MOS transistors (PM1, PM2, NM1, and NM2) constituting the switching circuit.

A constant bias voltage of 0 V is applied to the gate electrodes of the voltage-dropping PMOS transistors (PM21 and PM22) and a constant bias voltage of 5 V is applied to the voltage-dropping NMOS transistors (NM21 and NM22). Other aspects of the circuit are the same as those in FIG. 7.

The embodiment of the present invention uses the inverted signal of an output timing control clock (D1) as the output enable signal (ENB). However, it is also possible to generate the output enable signal (ENB) inside of the circuit by counting display-data latching clocks (D2).

When the PMOS transistor (PM1) is turned off and the NMOS transistor (NM2) is turned on, a voltage of up to 15 V is applied to both ends of a pair of transistors constituted by the PMOS transistors (PM1) and (PM21).

However, because the PMOS transistor (PM1) is turned off and no current flows through the pair of transistors, the source voltage (VS) of the PMOS transistor (PM21) is shown by the following expression (1).

[Numerical Formula 1]

$$VGS-VT=0$$
$$VG-VS-VT=0$$
$$VS-VG=VT \quad (1)$$

In the above expression, VGS denotes the gate-source voltage of the PMOS transistor (PM21), VG denotes the gate voltage of the PMOS transistor (PM21), and VT denotes the threshold voltage of the PMOS transistor (PM21).

That is, the source voltage (VS) of the PMOS transistor (PM21) becomes equal to the voltage obtained by subtracting the threshold voltage (VT) of the transistor (PM21) from the gate voltage (VG) of the transistor (PM21) and the source voltage of the PMOS transistor (PM21) becomes almost equal to its gate voltage (VG) (=0 V).

Because the source voltage (VS) of the PMOS transistor (PM21) is equal to the drain voltage (VD) of the PMOS transistor (PM1), it is possible to use a PMOS transistor with a high withstand voltage having a source-drain withstand voltage of 10 V, which is the same as that of the conventional example, as the PMOS transistor (PM1).

Moreover, when the PMOS transistor (PM1) is turned on and the NMOS transistor (NM2) is turned off, the source voltage (VS) of the NMOS transistor (NM22) becomes almost equal to its gate voltage (VG) (=5 V).

Therefore, it is possible to use a PMOS transistor with a high withstand voltage having a source-drain withstand voltage of 10 V as the NMOS transistor (NM2) similar to the case of the conventional example.

Moreover, because the bias voltage of 0 V to be applied to the gate electrode of the PMOS transistor (PM21) is a bias voltage for turning on the PMOS transistor (PM21), the output of the high-voltage amplifier circuit 271 is output to the drain signal line (Yn) through the PMOS transistor (PM21) when the PMOS transistor (PM1) is turned on.

Figure 9:
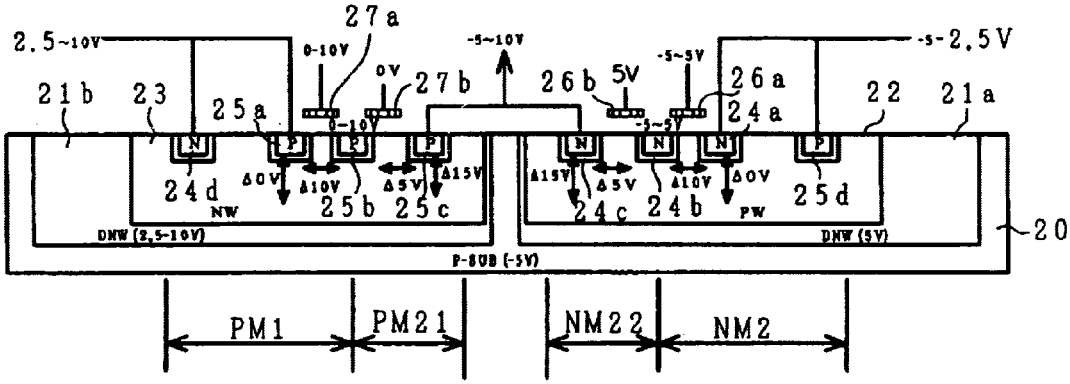
FIG. 9 is a sectional view of essential portions showing the sectional structures of the PMOS transistors (PM1 and PM21) and the NMOS transistors (NM2 and NM22) shown in FIG. 8.

FIG. 9 is a sectional view of essential portions showing the sectional structures of the PMOS transistors (PM1 and PM21) and the NMOS transistors (NM2 and NM22).

As shown in FIG. 9, a first n-well region 21*a* is formed on a p-type semiconductor substrate 20 and a p-well region 22 is formed in the first n-well region 21*a*.

In this case, a voltage of −5 V is applied to the p-type semiconductor substrate 20 and a voltage of 5 V is applied to the first n-well region 21*a*.

The NMOS transistors (NM2) and (NM22) are constituted with semiconductor regions (24*a*, 24*b*, and 24*c*) formed in the p-well region 22 and gate electrodes (26*a* and 26*b*).

In this case, the n-type semiconductor region (24*b*) is used as the drain region of the NMOS transistor (NM2) and the source region of the NMOS transistor (NM22). Moreover, a negative-polarity gradation voltage is applied to the p-well region 22 from the low-voltage amplifier circuit 272 by a p-type semiconductor region 25*d*.

Similarly, a second n-well region 21*b* is formed on the p-type semiconductor substrate 20 and a third n-well region 23 is formed in the second n-well region 21*b*. In this case, a positive-polarity gradation voltage is applied to the second n-well region 21*b* and third n-well region 23 from the high-voltage amplifier circuit 271 by an n-type semiconductor region 24*d*.

The PMOS transistors (PM1 and PM21) are constituted with p-type semiconductor regions (25*a*, 25*b*, and 25*c*) and gate electrodes (27*a* and 27*b*).

In this case, the p-type semiconductor region (25*b*) is used as the drain region of the PMOS transistor (PM1) and the source region of the PMOS transistor (PM21).

Moreover, FIG. 9 illustrates the maximum withstand voltages between the n-type semiconductor regions (24*a*, 24*b*, and 24*c*), between the p-type semiconductor regions (25*a*, 25*b*, and 25*c*), and between each of the n-type semiconductor regions (24*a*, 24*b*, and 24*c*), each of the p-type semiconductor regions (25*a*, 25*b*, and 25*c*), and each well region.

FIGS. 10A to 10E and 11A to 11E are sectional views for explaining the outline of the fabrication steps in the manufacture of the PMOS transistors (PM1 and PM21) and the NMOS transistors (NM2 and NM22).

A method for forming the PMOS transistors (PM1 and PM21) and the NMOS transistors (NM2 and NM22) will be briefly described below with reference to FIGS. 10A to 10E and 11A to 11E.

Figure 10A:
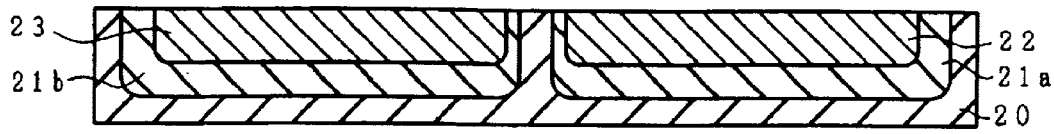
FIGS. 10A to 10E are sectional views for explaining the outline of fabrication steps in the manufacture of the PMOS transistors (PM1 and PM21) and the NMOS transistors (NM2 and NM22) shown in FIG. 8.

First, the p-type semiconductor substrate 20 made of single crystal silicon is prepared to form the first n-well region 21*a*, second n-well region 21*b*, p-well region 22, and third n-well region 23 through selective ion implantation of p- and n-type region decision impurities. {FIG. 10A}

In this case, the first n-well region 21*a*, second n-well region 21*b*, and third n-well region 23 use phosphorus (P) as an n-type region decision impurity. A quantity of impurity to be introduced into the first n-well region 21*a* and the second n-well region 21*b* is set to approximately $5.4\times10^{12}$[atoms/$cm^2$] and a quantity of impurity to be introduced into the third n-well region 23 is set to approximately $1.0\times10^{12}$ [atoms/$cm^2$].

Moreover, the p-well region 22 uses boron fluoride ($BF_2$) and the quantity of impurity to be introduced into the region 22 is set to approximately $1.1\times10^{13}$[atoms/$cm^2$].

Figure 10B:
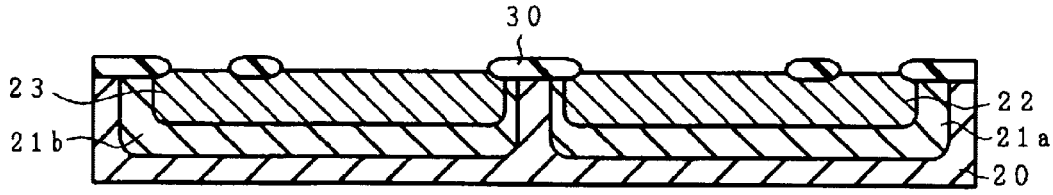

Then, a field insulating film 30 made of a silicon oxide film is formed on the principal plane of the element separation region of the p-type semiconductor substrate 20 by the publicly-known selective oxidation method. {FIG. 10B}

Figure 10C:
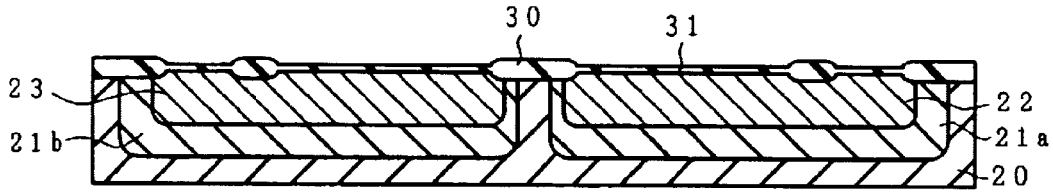
Figure 10D:
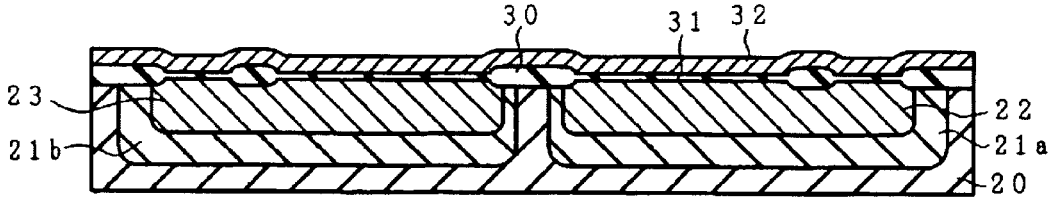

Then, thermal oxidation treatment is performed to form a gate-electrode insulating film 31 made of a silicon oxide film on the principal planes of the p-type well region 22 and the third n-well region 23 and then a polysilicon film 32 is deposited on the gate-electrode insulating film 31 by, for example, the CVD method. {FIG. 10C and FIG. 10D}

Figure 10E:
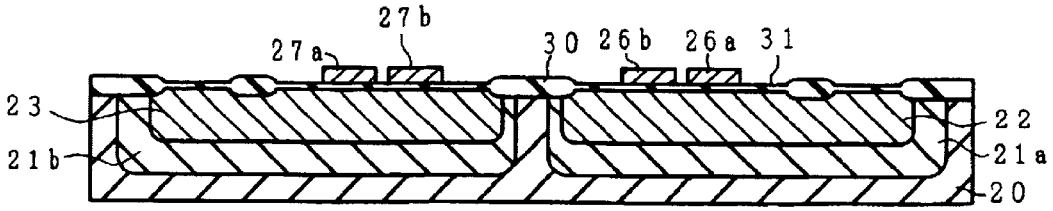

Then, patterning is applied to the polysilicon film 32 to form gate electrodes (26*a*, 26*b*, 27*a*, and 27*b*) on the gate-electrode insulating films 31 of the p-well region 22 and the third n-well region 23. {FIG. 10E}

Then, a mask 33 is formed on the p-type semiconductor substrate 20. The mask 33 is formed with, for example, a photoresist film locally having an aperture on the third n-well region 23 and p-well region 22 to cover the remaining region of the p-well region 22. The photoresist film is coated by the spin coating method and baked and, thereafter, is formed by being exposed and developed.

Then, the p-type semiconductor regions (25*a*, 25*b*, 25*c*, and 25*d*) are formed by using the mask 33 and gate electrodes (27*a* and 27*b*) as impurity introduction masks, thereby introducing a p-type region decision impurity in accordance with the ion implantation method, and performing annealing. In this case, the impurity used is boron fluoride ($BF_2$) and ion implantation is performed twice to first form a p-type semiconductor region having an impurity introduction quantity of approximately $3.0\times10^{14}$[atoms/$cm^2$] and then, forming a p-type semiconductor region having an impurity introduction quantity of approximately $2.0\times10^{15}$[atoms/$cm^2$].

That is, the p-type semiconductor regions (25*a*, 25*b*, 25*c*, and 25*d*) are formed so that a p-type semiconductor region having a high impurity concentration is enclosed by a p-type semiconductor region having a low impurity concentration. Thereby, the impurity concentration gradient is moderated and the withstand voltage to a well region is improved. {FIG. 11A}

Then, the mask 33 is removed and a mask 34 is formed on the p-type semiconductor substrate 20. The mask 34 is made of, for example, a photoresist film locally having an aperture on the p-well region 22 and third n-well region 23 and covering the remaining region of the third n-well region 23.

Then, the n-type semiconductor regions (24*a*, 24*b*, 24*c*, and 24*d*) are formed by using the mask 34 and the gate electrodes (26*a* and 26*b*) as impurity introduction masks, thereby introducing an n-type region decision impurity in accordance with the ion implantation method and performing annealing. In this case, ion implantation is performed twice similar to the case of the above process to first form an n-type semiconductor region having an impurity introduction quantity of approximately $3.0\times10^{13}$[atoms/cm$^2$] by using phosphorus as an impurity and then an n-type semiconductor region is formed having an impurity introduction quantity of approximately $3.0\times10^{15}$[atoms/cm$^2$] by using arsenic (As) as an impurity.

That is, the n-type semiconductor regions (24*a*, 24*b*, 24*c*, and 24*d*) are formed so that an n-type semiconductor region having a high impurity concentration is enclosed by an n-type semiconductor region having a low impurity concentration. Thereby, the impurity concentration gradient is moderated and the withstand voltage to a well region is improved. {FIG. 11B}

Figure 11A:
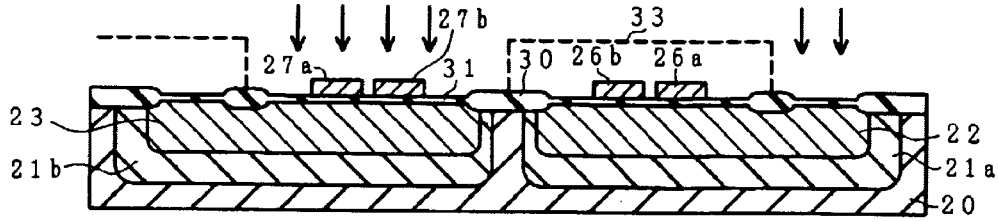
FIGS 11A to 11E are sectional views for explaining the outline of further fabrication steps in the manufacture of the PMOS transistors (PM1 and PM21) shown in FIG. 8.
Figure 11B:
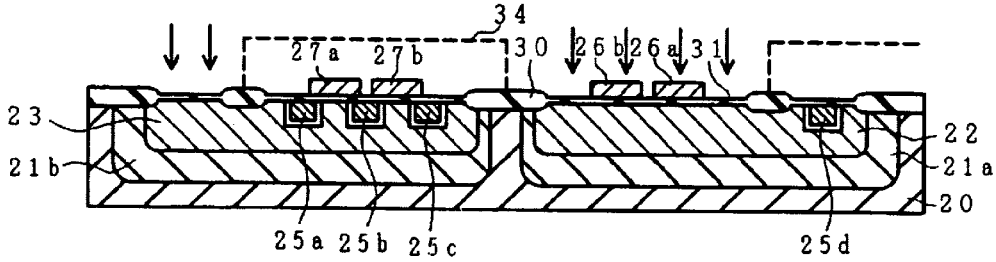
Figure 11C:
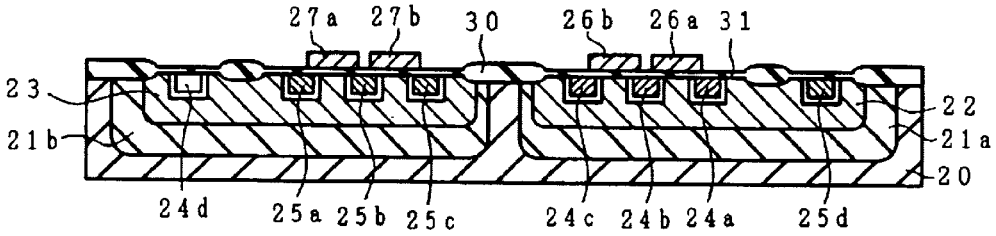
Figure 11D:
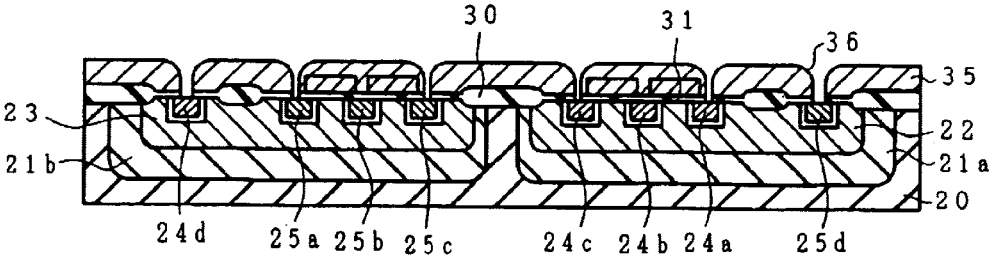

Then, as shown in FIG. 11C, the mask 34 is removed and thereafter, a layer insulating film 35 made of a silicon oxide film is formed on the p-type semiconductor substrate 20 and a connection hole 36 where the surfaces of the n-type semiconductor regions (24*a*, 24*c*, and 24*d*) and those of the p-type semiconductor regions (25*a*, 25*c*, and 25*d*) are exposed is formed on the layer insulating film 35. {FIG. 11D}

Figure 11E:
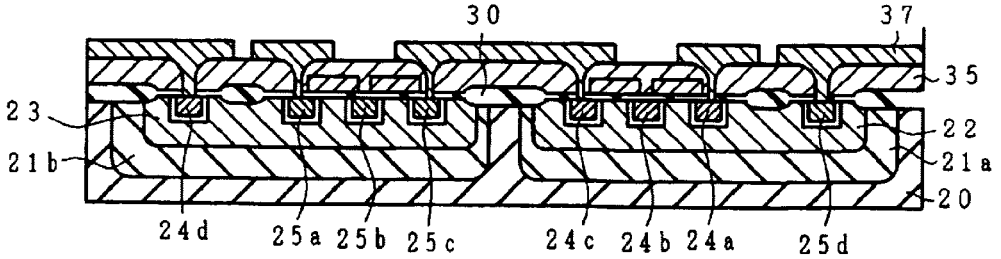

Then, aluminum is vacuum-deposited on the p-type semiconductor substrate 20 and, thereafter, aluminum other than wiring is removed through etching. {FIG. 11E}

As described above, according to an embodiment of the present invention, it is possible to use a MOS transistor having a source-drain withstand voltage of 10 V as the switching element of the switching section (2) 264 to both ends of which a voltage of up to 15 V is applied. Thus, it is possible to decrease the area of the switching section (2) 264 compared to the case of using a MOS transistor with high withstand voltage having a source-drain withstand voltage of 15 V as the switching element of the switching section (2) 264. Thereby, it is possible to decrease the chip size of the drain driver 130 and, accordingly, to reduce the cost of the liquid crystal display module (LCM).

Now, the high-voltage decoder circuit 278 representing an embodiment of the present invention will be described below with reference to FIG. 12.

Figure 12:
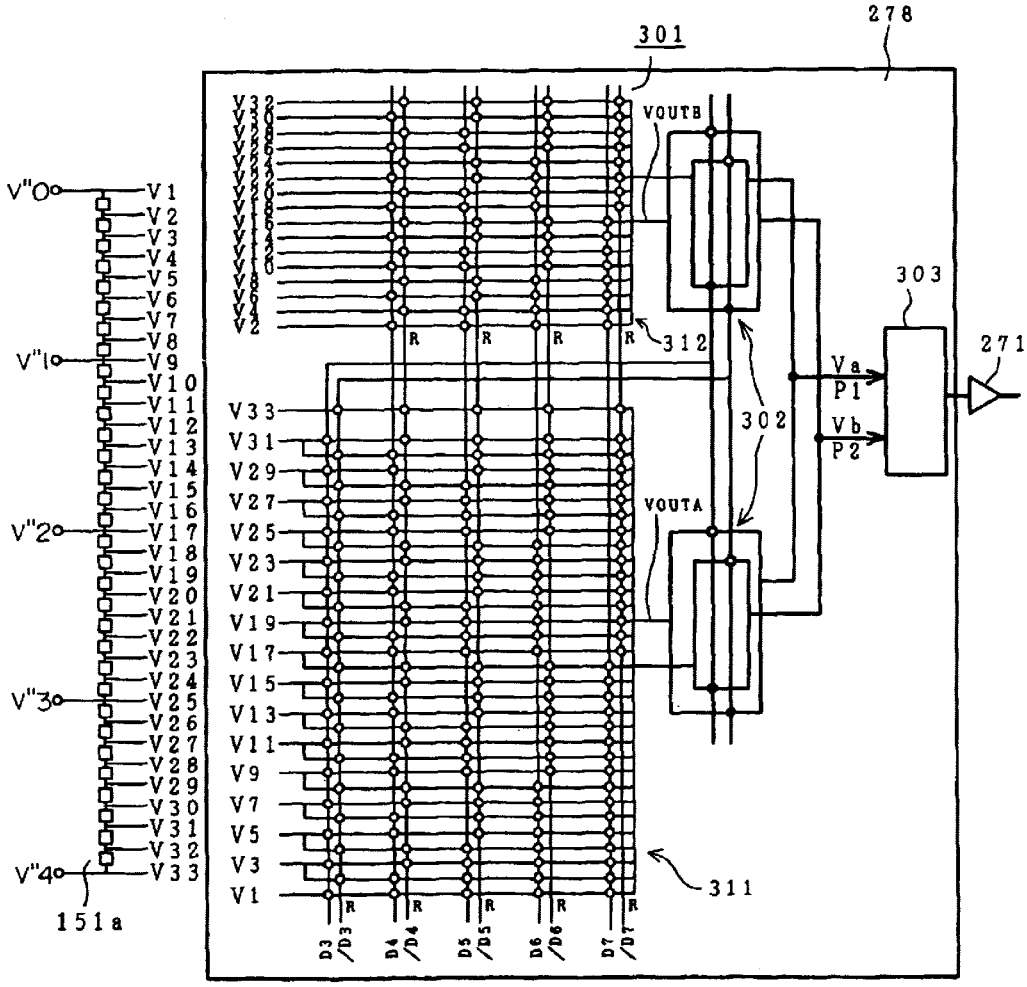
FIG. 12 is a schematic circuit diagram showing an example of the high-voltage decoder circuit according to an embodiment of the present invention.

FIG. 12 is a circuit diagram showing an example of the high-voltage decoder circuit 278 forming an embodiment of the present invention.

FIG. 12 also shows a schematic structure of the positive-polarity gradation voltage generation circuit 151*a*.

As shown in FIG. 12, the positive-polarity gradation voltage generation circuit 151*a* generates first positive-polarity gradation voltages of 33 gradations in accordance with five positive-polarity gradation reference voltages (V"0 to V"4) supplied from the positive-voltage generation circuit 121.

Figure 29:
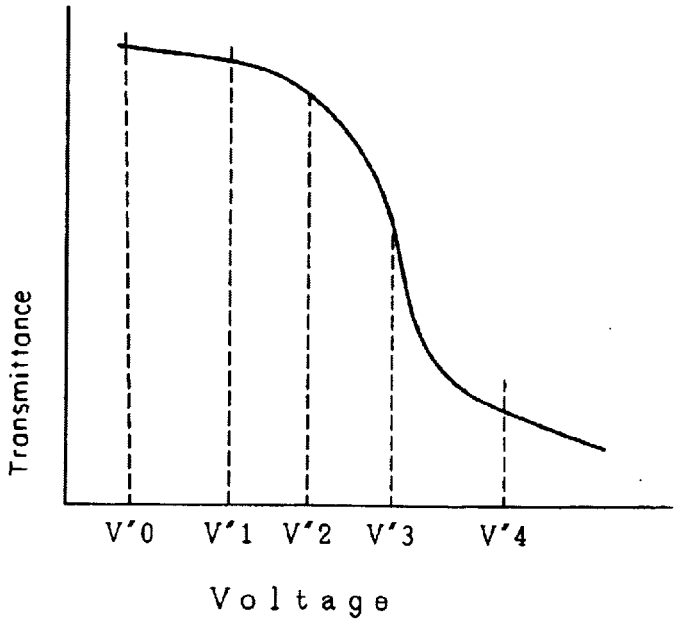
FIG. 29 is a graph showing the relation between the voltage applied to a liquid crystal layer and the transmittance.
Figure 30:
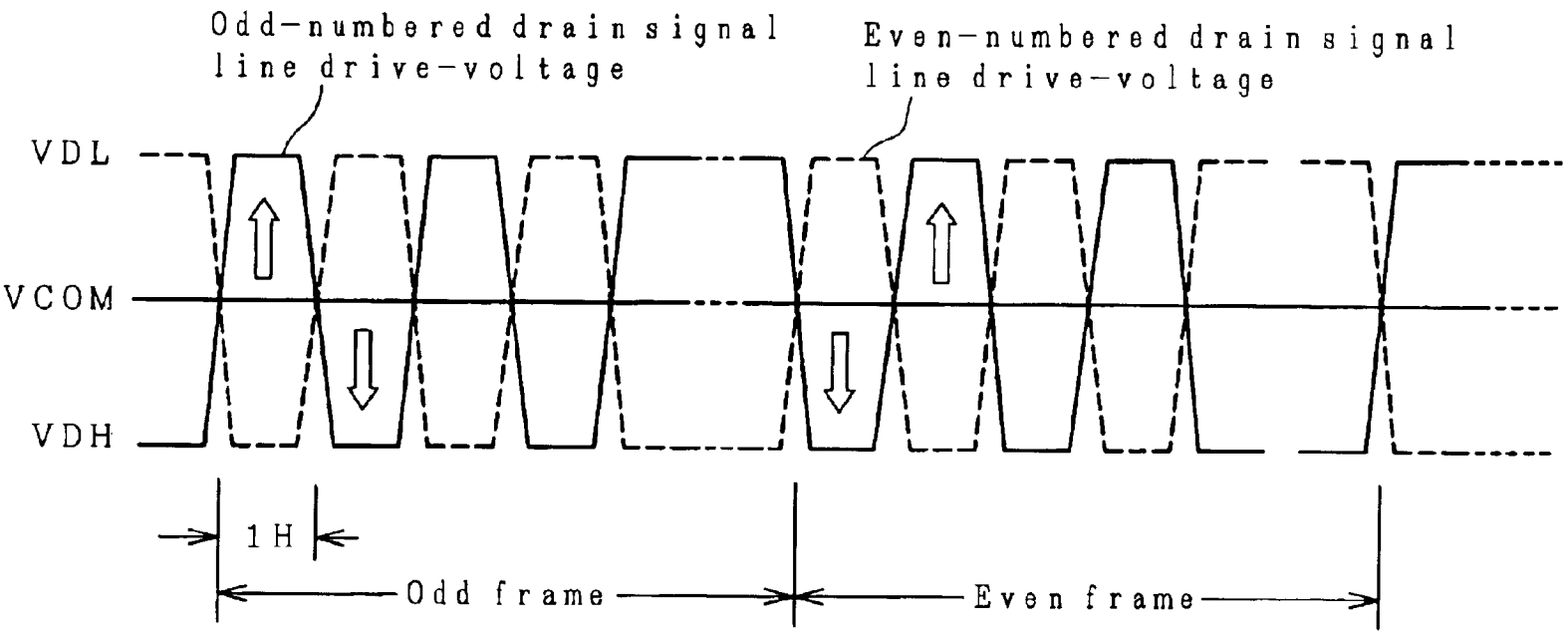
FIG. 30 is a signal diagram showing the relation between the driving voltage applied to a pixel electrode and the driving voltage applied to a common electrode in the case of the dot inversion method.

In this case, the relation between the voltage applied to a liquid crystal layer and the transmittance of the liquid crystal layer is not linear. As shown in FIG. 29, the transmittance of the liquid crystal layer does not greatly change at a portion where the voltage applied to the liquid crystal layer is high or low, but the transmittance of the liquid crystal layer greatly changes in an intermediate range of the voltage applied to the liquid crystal layer.

Therefore, as shown in FIG. 29, the five positive-polarity gradation reference voltages (V"0 to V"4) are set so that the differences between the voltages V1"1 and V"2 and between the voltages V"2 and V"3 in an intermediate range of the voltages V"0 to V"4 are smaller than the differences between the voltages V"0 and V"1 and between the voltages V"3 and V"4 in low and high ranges of the voltages V"0 to V"4. Moreover, each voltage-division resistance of a resistance voltage-division circuit constituting the positive-polarity gradation voltage generation circuit 151*a* is provided with a predetermined weight in accordance with the relation between the voltage applied to the liquid crystal layer and the transmittance of the liquid crystal layer.

In the case of the positive-polarity gradation voltage generation circuit in FIG. 12, five positive-polarity gradation reference voltages (V"0 to V"4) are divided into 8 levels to generate first gradation voltages of 33 gradations. However, it is needless to say that the voltage division ratio between the five positive-polarity gradation reference voltages (V"0 to V"4) can be properly changed in accordance with the relation between the voltage applied to the liquid crystal layer and the transmittance of the liquid crystal layer.

The high-voltage decoder circuit 278 has a decoder circuit 301 for selecting first adjacent gradation voltages (VOUTA and VOUTB) of the first gradation voltages of 33 gradations, a multiplexer 302 for outputting the first gradation voltage (VOUTA) selected by the decoder circuit 301 to a terminal (P1) or a terminal (P2) and outputting the first gradation voltage (VOUTB) selected by the decoder circuit 301 to the terminal (P2) or (P1), and a second gradation voltage generation circuit 303 for dividing the potential difference ($\Delta V$) between the adjacent first gradation voltages (VOUTA and VOUTB) outputted from the multiplexer 302 and generating $\frac{1}{8}\Delta V$, $\frac{2}{8}\Delta V$, $\frac{3}{8}\Delta V$, $\frac{4}{8}\Delta V$ ($\frac{1}{2}\Delta V$), $\frac{5}{8}\Delta V$, $\frac{6}{8}\Delta V$, $\frac{7}{8}\Delta V$, and $\frac{8}{8}$ (=1) $\Delta V$ of the potential difference ($\Delta V$).

The decoder circuit 301 is constituted with a first decoder circuit 311 for selecting first gradation voltages corresponding to the five high-order bits (D3 to D7) of 8-bit display data and a second decoder circuit 312 for selecting first gradation voltages corresponding to the four high-order bits (D4 to D7) of the 8-bit display data.

The first decoder circuit 311 is constituted so as to select the 1st first-gradation voltage (V1) and the 33rd first-gradation voltage (V33) once and to select odd-numbered ones of the 3rd first-gradation voltage (V3) to the 31st first-gradation voltage (V31) twice consecutively in accordance with the five high-order bits (D3 to D7) of the 8-bit display data.

However, the second decoder circuit 312 is constituted so as to select even-numbered ones of the 2nd first-gradation voltage (V2) to the 32nd first-gradation voltage (V32) once in accordance with the four high-order bits (D4 to D7) of the 8-bit display data.

In FIG. 12, symbol ○ denotes a switching element (e.g. PMOS transistor) to be turned on when a data bit is L-level.

In this case, because the relation of V"0<V"1<V"2<V"3<V"4 is effectuated, when the value of the bit 4 (D3) of the display data is L-level, a gradation voltage having a potential lower than that of the gradation voltage VOUTB is outputted as the gradation voltage VOUTA. Moreover, when the value of the bit 4 (D3) of the display data is H-level, a gradation voltage having a potential higher than that of the gradation voltage VOUTB is outputted as the gradation voltage VOUTA.

Therefore, the multiplexer 302 is switched in accordance with the H-level and L-level value of the bit 4 (D3) of the display data, the gradation voltage VOUTA is outputted to the terminal (P1) and the gradation voltage VOUTB is outputted to the terminal (P2) when the value of the bit 4 (D3) of the display data is L-level, and the gradation voltage VOUTB is outputted to the terminal (P1) and the gradation voltage VOUTA is outputted to the terminal (P2) when the value of the bit 4 (D3) of the display data is H-level.

Thereby, whenever the gradation voltage of the terminal (P1) is set to (Va) and that of the terminal (P2) is set to (Vb), it is possible to effectuate the relation Va<Vb. Thus, the design of the second gradation voltage generation circuit 303 is simplified.

Figure 13:
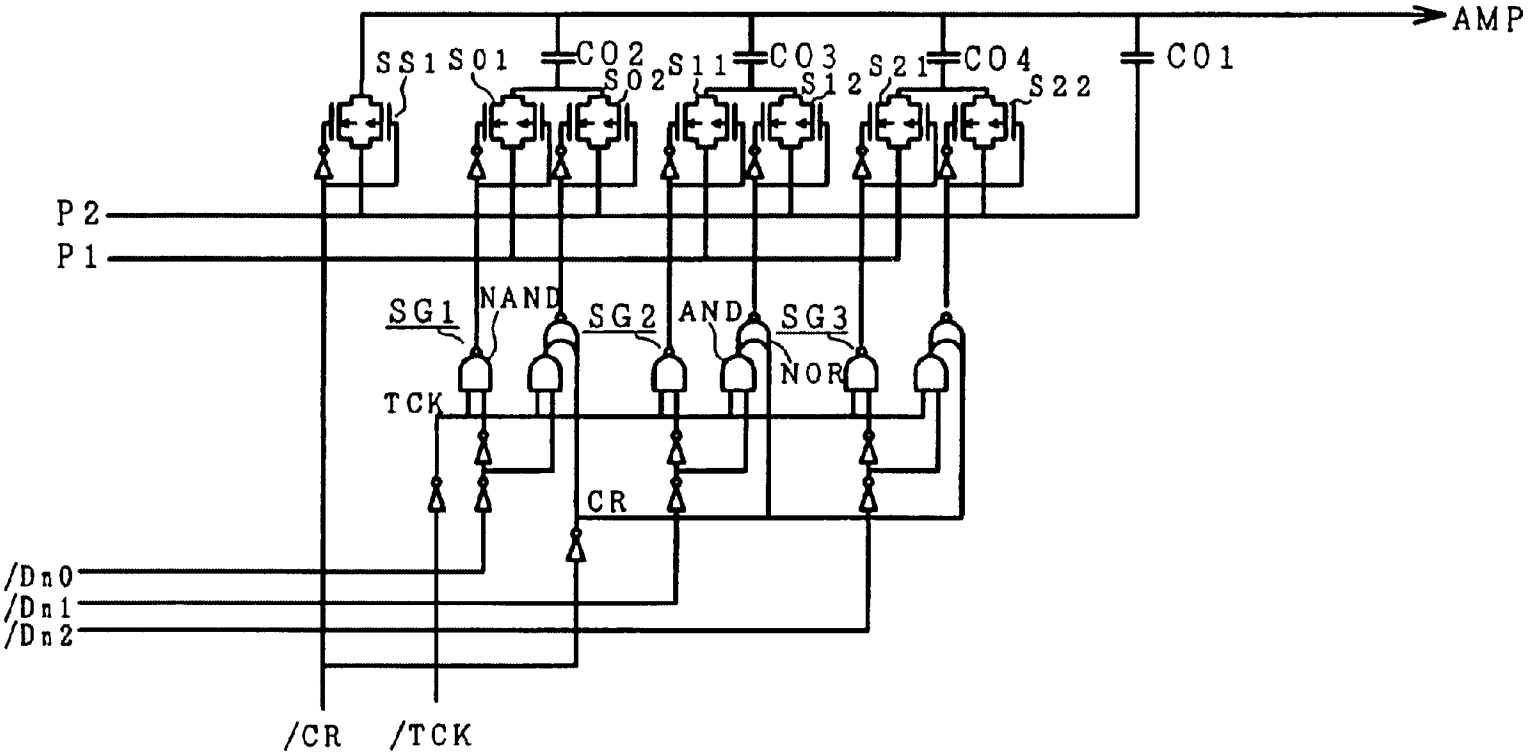
FIG. 13 is a schematic circuit diagram showing an example of the second gradation-voltage generation circuit shown in FIG. 12.

FIG. 13 is a circuit diagram showing an example of the structure of the second gradation voltage generation circuit 303 shown in FIG. 12.

The second gradation voltage generation circuit 303 has a capacitor (Co1) connected between the terminal (P2) and the input terminal of the amplifier circuit (high-voltage amplifier circuit 271), a capacitor (Co2) whose one end is connected to the input terminal of the amplifier circuit and whose other end is connected to the terminal (P1) through a switching element (S01) and, moreover, is connected to the terminal (P2) through a switching element (S02), a capacitor (Co3) whose one end is connected to the input terminal of the amplifier circuit and whose other end is connected to the terminal (P1) through a switching element (S11) and, moreover, is connected to the terminal (P2) through a switching element (S12), a capacitor (Co4) whose one end is connected to the input terminal of the amplifier circuit and whose other end is connected to the terminal (P1) through a switching element (S21) and, moreover, is connected to the terminal (P2) through a switching element (S22), and a switching element (SS1) connected between the terminal (P2) and the input terminal of an amplifier.

In this case, the capacitor (Co1) has the same capacitance as that of the capacitor (Co2), the capacitor (Co3) has a capacitance two times larger than that of the capacitor (Co1), and the capacitor (Co4) has a capacitance four times larger than that of the capacitor (Co1).

Moreover, as shown in FIG. 13, the switching element (SS1) is controlled in accordance with a reset pulse (/CR) and the switching elements (S01, S02, S11, S12, S21, and S22) are controlled in accordance with the reset pulse (/CR), a timing pulse (/TCK), and switching control circuits (SG1 to SG3) to which the three low-order bits (D0 to D2) of display data are inputted.

The switching control circuits (SG1 to SG3) are respectively provided with a NAND circuit (NAND), AND circuit (AND), and NOR circuit (NOR). Table 2 shows a truth table for the NAND circuit (NAND), AND circuit (AND), and NOR circuit (NOR).

TABLE 2

| /CR | /TCK | /D | NAND | AND | NOR | Sn1 | Sn2 |
|---|---|---|---|---|---|---|---|
| L | H | * | H | L | L | OFF | ON |
| H | H | * | H | L | H | OFF | OFF |
| | L | H | L | L | H | ON | OFF |
| | | L | H | H | L | OFF | ON |

Symbol * denotes that there is no relation with display data.

Operations of the second gradation voltage generation circuit 303 will be briefly described below with reference to Table 2. First, when the reset pulse (/CR) is L-level, the switching element (SS1) is turned on. Moreover, because the H-level reset pulse (/CR) is inputted to the NOR circuit (NOR), the output of the NOR circuit (NOR) becomes L-level and the switching elements (S02, S12, and S22) are turned on.

In this case, the timing pulse (/TCK) is H-level and the L-level timing pulse (/TCK) is inputted to the NAND circuit (NAND), the output of the NAND circuit (NAND) becomes H-level and the switching elements (S01, S11, and S21) are turned off. Thereby, because both ends of the capacitors (Co1 to Co4) are connected to the terminal (P2), the capacitors (Co1 to Co4) are discharged and the potential difference between the capacitors is set to 0 V.

Then, when the reset pulse (/CR) is H-level and the timing pulse (/TCK) becomes L-level, the switching elements (S01, S02, S11, S12, S21, and S22) are turned on or off in accordance with the value of each of the three low-order bits (D0 to D2) of display data.

Thereby, by assuming that the gradation voltage of the terminal (P1) is (Va), the gradation voltage of the terminal (P2) is (Vb), and the potential difference between Va and Vb is ΔV, gradation voltages of Va+⅛ ΔV, Va+⅔ ΔV, . . . Vb (Va+⅝ ΔV) are outputted from the, second gradation voltage generation circuit 302.

To display 256 gradations by using the high-voltage decoder circuit 278 of the full-code system, 16 transistors are necessary for every 256 gradations. Therefore, the total number of MOS transistors per drain signal line (D) becomes 4,096 (256×16).

Therefore, problems occur in that the area occupied by the decoder section 261 increases and the chip size of a semiconductor integrated circuit (IC chip) increases.

In the case of the high-voltage decoder circuit 278 representing an embodiment of the present invention, the number of switching elements constituting a decoder circuit becomes 160 {=(17+15)×5} for the first decoder circuit 311 and 64 (=4×16) for the second decoder circuit 312. Therefore, the total number of switching elements (MOS transistors) constituting a decoder circuit per drain signal line (D) becomes 224. Thus, it is possible to greatly decrease the number of MOS transistors per drain signal line (D) compared to the 4,096 MOS transistors per drain signal line (D) required for the conventional example.

Moreover, by decreasing the number of switching elements, it is possible to reduce the internal current of the drain driver 130. Therefore, it is possible to reduce the total power consumption of the liquid crystal display module (LCM), thereby improving the reliability of the liquid crystal display module (LCM).

Moreover, the low-voltage decoder circuit 279 can be constituted similarly to the high-voltage decoder circuit 278. In this case, the negative-polarity gradation voltage generation circuit 151*b* generates first negative-polarity gradation voltages of 33 gradations in accordance with five negative-polarity gradation reference voltages (V"5 to V"9) inputted from the negative voltage generation circuit 122.

In this case, each voltage-division resistance of a resistance voltage-division circuit constituting the negative-polarity gradation voltage generation circuit 151*b* is provided with a predetermined weight in accordance with the relation between the voltage applied to a liquid crystal layer and the transmittance of the liquid crystal layer.

In the case of the low-voltage decoder circuit 279, because the relation V"5>V"6>V"7>V"8>V"9 is effectuated, an inequality of Va>Vb is always obtained when assuming that the gradation voltage of the terminal (P1) is (Va) and that of the terminal (P2) is (Vb).

Figure 14:
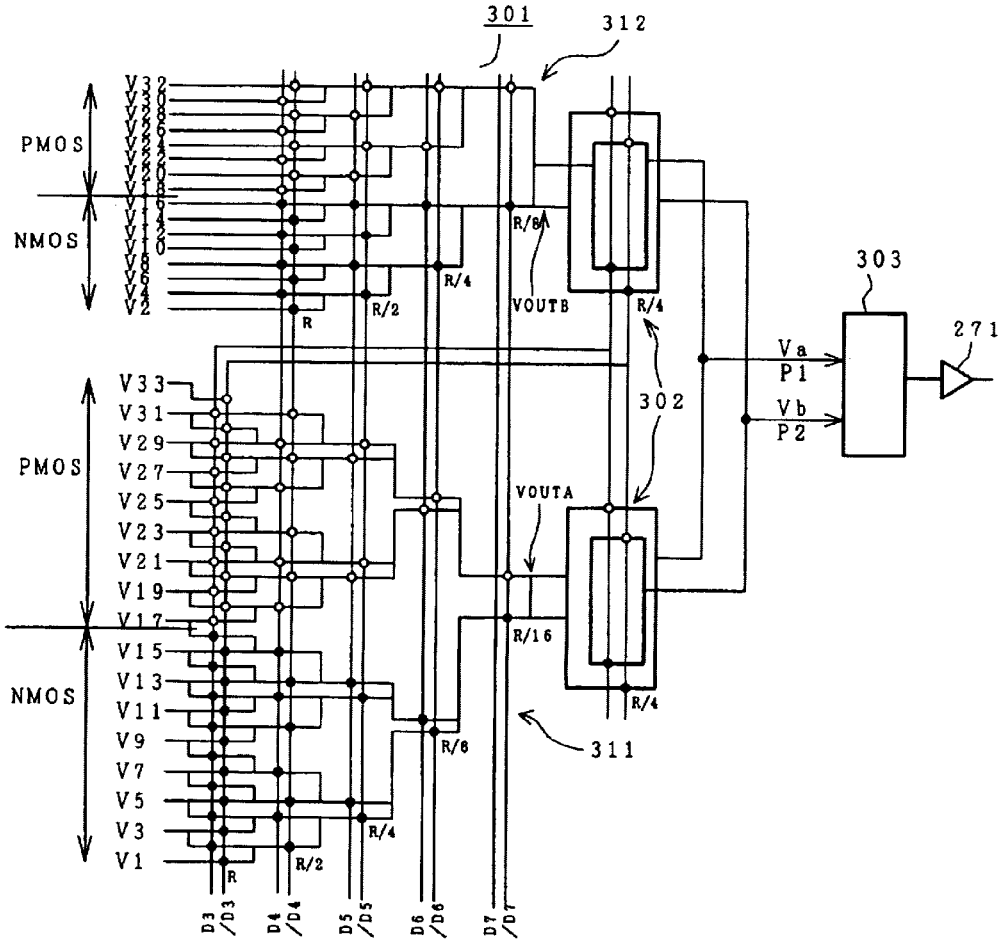
FIG. 14 is a schematic circuit diagram showing another example of the high-voltage decoder circuit according to the present invention.
Figure 15:
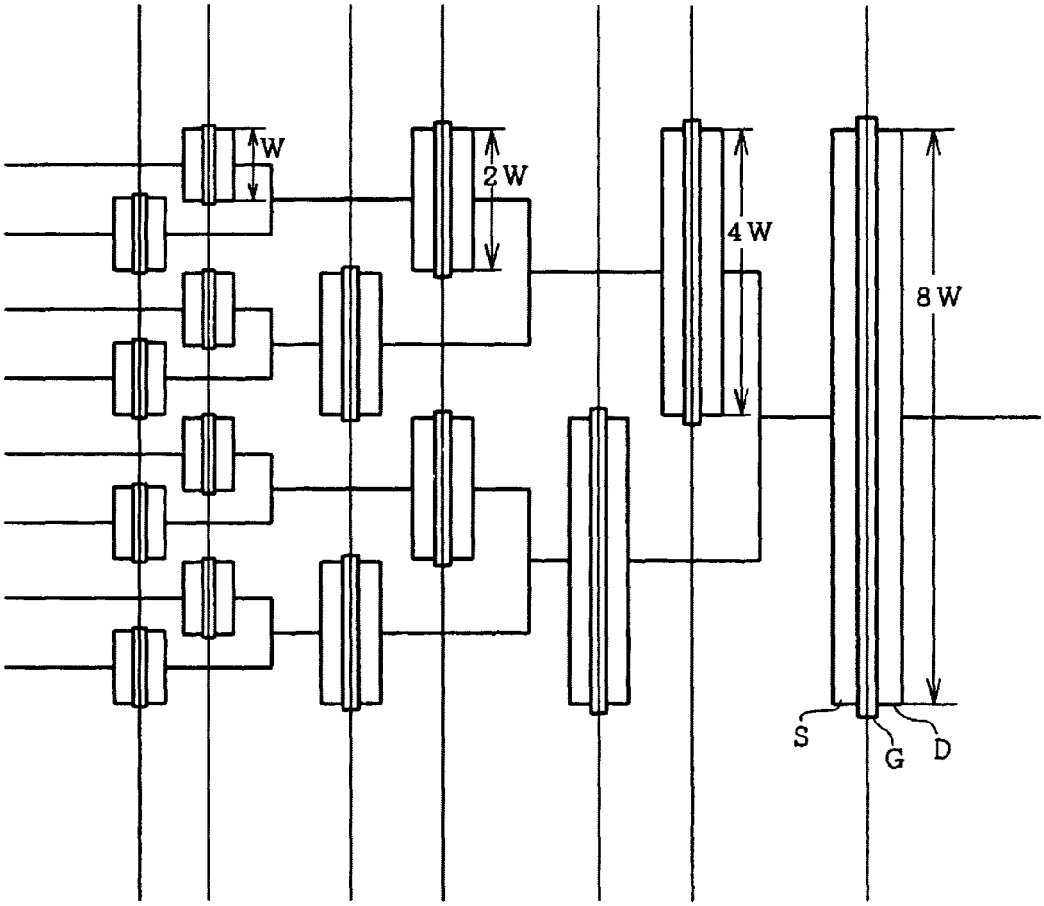
FIG. 15 is a diagram for explaining the gate width of a MOS transistor constituting the high-voltage decoder circuit of the present invention.

FIG. 14 is a circuit diagram showing another example of the high-voltage decoder circuit 278 forming an embodiment of the present invention, and FIG. 15 is a schematic view for explaining the gate width of a MOS transistor constituting the high-voltage decoder circuit 278 shown in FIG. 14.

In FIG. 14, symbol ○ denotes a PMOS transistor and symbol ● denotes an NMOS transistor.

In the case of the high-voltage decoder circuit 278 shown in FIG. 12, the number of MOS transistors having the same voltage applied to their gate electrodes for every decoding row increases for higher bits of display data.

Therefore, even if the same voltage is applied to a gate electrode for every column and MOS transistors continued for every decoding row are replaced with one MOS transistor, there is no functional problem.

The embodiment of the present invention shown in FIGS. 14 and 15 is constituted by replacing MOS transistors having the same voltage applied to their gate electrodes for every column and which are continued for every decoding row with one MOS transistor.

Moreover, in the case of an embodiment of the present invention, when assuming that the gate width of a minimum-size MOS transistor is W, the gate width of a MOS transistor at a higher-order column than the minimum-size MOS transistor is set to 2 W and the gate width of a MOS transistor at a higher-order column than the above MOS transistor is set to 4 W, as shown in FIG. 15. That is, the gate width (W) of a MOS transistor (MOS transistor at the higher-order bit side) in which a high-order bit of display data is applied to its gate electrode is set to a value $2^{(m-j)}$ times larger than the gate width of the minimum size MOS transistor.

In this case, symbol m denotes the number of bits of display data and j denotes the bit number of the most significant bit among the bits constituted with the minimum size MOS transistor. In the case of an embodiment of the present invention, when assuming that the resistance of a minimum size MOS transistor is R, the combined resistance of MOS transistors at each decoding row becomes approximately 2R (≈R+R/2+R/4+R/8+R/16) for the decoder circuit 311 and approximately 2R (≈R+R/2+R/4+R/8) for the decoder circuit 312.

Moreover, FIG. 12 shows the resistance of the MOS transistor at each column when assuming that the resistance of the minimum size MOS transistor is R.

In the case of the high-voltage decoder circuit 278 shown in FIG. 12, when assuming that the resistance of the minimum size MOS transistor is R, the combined resistance of the MOS transistors at each decoding row becomes 5R (=R+R+R+R+R) for the decoder circuit 311 and 4R (=R+R+R+R) for the decoder circuit 312.

Therefore, in the case of the high-voltage decoder circuit 278 shown in FIG. 14, it is possible to reduce the combined resistance of the MOS transistors at each decoding row and cause a large discharge current to flow when redistributing electric charges to the capacitors constituting the second gradation voltage generation circuit 303. Thus, it is possible to accelerate the operation speed of a decoder circuit and equalize the combined resistance of the decoder circuit 311 with that of the decoder circuit 312, thereby reducing the speed difference between two gradations to be generated.

Moreover, in the case of a MOS transistor, the threshold voltage ($V_T$) changes in the positive direction due to the substrate-source voltage ($V_{DS}$), thereby decreasing the drain current ($I_{DS}$) in general. That is, the on-resistance of the MOS transistor increases.

Therefore, in the case of the high-voltage decoder circuit 278 shown in FIG. 14, a PMOS transistor region and an NMOS transistor region are separated from each other at both sides of the gradation voltage at which the substrate-source voltage ($V_{BS}$) is equalized {gradation voltage of V16 (or V18) or V15 (or V17) in FIG. 14} as shown in FIG. 14.

Thereby, the high-voltage decoder circuit 278 shown in FIG. 14 makes it possible to prevent the resistance of a MOS transistor constituting a decoder circuit from increasing due to the substrate bias effect.

Figure 16:
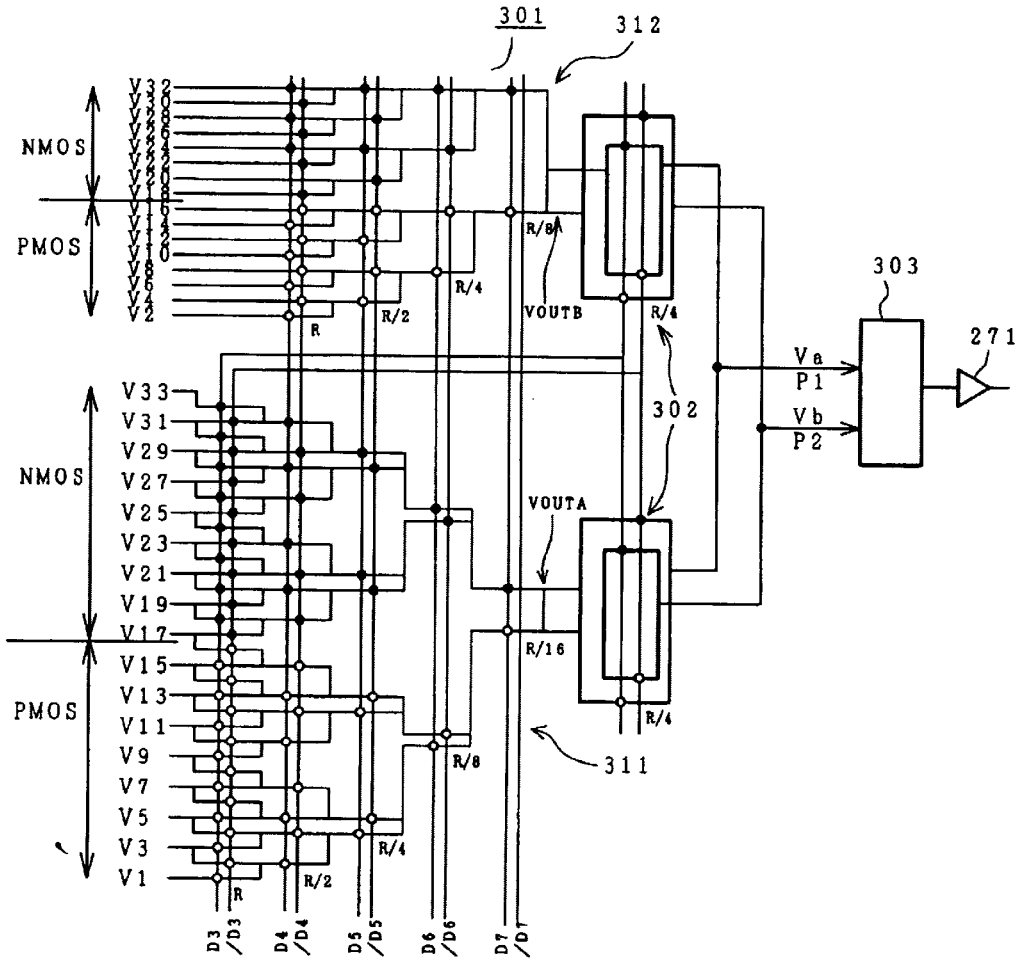
FIG. 16 is a schematic circuit diagram showing an example of the low-voltage decoder circuit according to an embodiment of the present invention.

FIG. 16 is a circuit diagram showing an example of the low-voltage decoder circuit 279 according to an embodiment of the present invention.

As shown in FIG. 16, the low-voltage decoder circuit 279 can be constituted similarly to the high-voltage decoder circuit 278 shown in FIG. 14. However, voltages have the relation of V1>V2>V3> . . . >V32>V33.

In the case of the low-voltage decoder circuit 279, the PMOS transistor region and the NMOS transistor region are opposite to the case of the high-voltage decoder circuit 278 when separating the PMOS transistor region from the NMOS transistor region at both sides of the gradation voltage at which the substrate-source voltage ($V_{BS}$) is equalized {V16 (or V18) or V15 (or V17) in FIG. 16}.

Moreover, in the decode circuits shown in FIGS. 12 to 16, each MOS transistor constituting the decoder circuit 301 is constituted by a MOS transistor with a high withstand voltage or a MOS transistor only whose gate electrode has a structure with a high withstand voltage.

Furthermore, a MOS transistor at the low-bit side of the decoder circuit 301 can use a MOS transistor having a low drain-source withstand voltage. In this case, it is possible to further decrease the size of the decoder circuit 301.

Furthermore, the second gradation voltage generation circuit 303 can use resistors instead of capacitors. In this case, however, it is necessary to use resistors having high resistances, and to select the resistances of the resistors so that the ratios of the resistances are inverse to the ratios of the capacitances of the capacitors.

For example, when using resistors for the second gradation voltage generation circuit 303 instead of capacitors, it is necessary that resistors which replace the capacitors (Co1) and (Co2) each have a resistance four times larger than the resistance of a resistor which replaces the capacitor (Co4), and that a resistor which replaces the capacitor (Co3) has a resistance two times larger than the resistance of a resistor which replaces the capacitor (Co4).

Figure 17:
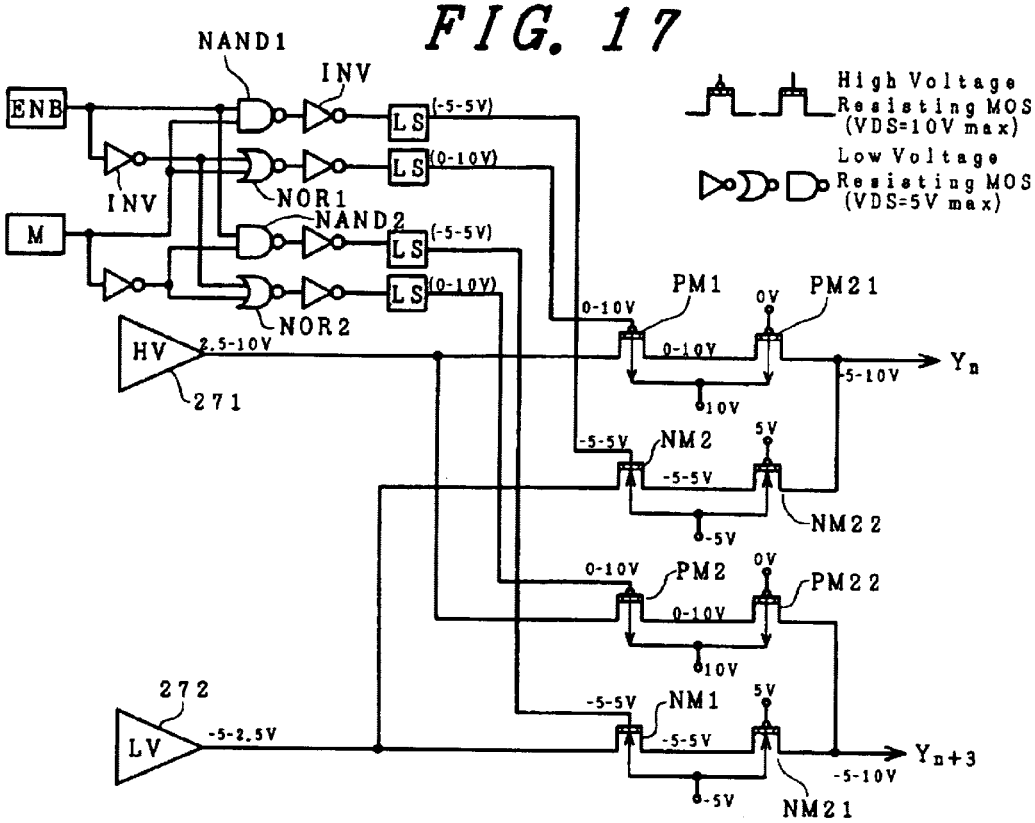
FIG. 17 is a schematic circuit diagram showing a switching circuit in the switching section of an embodiment of the present invention.

FIG. 17 is a circuit diagram showing the structure of a switching circuit of the switching section (2) 264 according to an embodiment of the present invention.

This embodiment of the present invention is different from the foregoing embodiments of the present invention in that a constant bias voltage is applied to a p-well region 22 and a third n-well region 23 on which MOS transistors (PM1, PM2, NM1, and NM2) and voltage-dropping MOS transistors (PM21, PM22, NM21, and NM22) are formed. However, the other structures are the same as those of the foregoing embodiments of the present invention.

Figure 18:
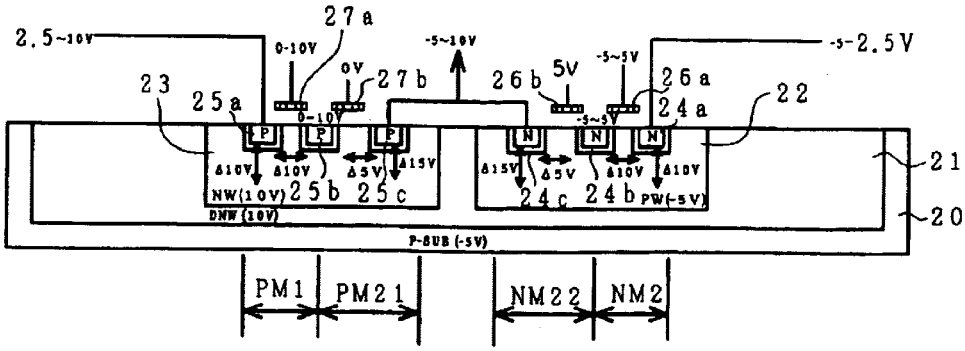
FIG. 18 is a sectional view of essential portions of the PMOS transistors (PM1 and PM21) and the NMOS transistors (NM2 and NM22) shown in FIG. 17.

FIG. 18 is a sectional view of essential portions showing sectional structures of the PMOS transistors (PM1 and PM21) and NMOS transistors (NM2 and NM22) shown in FIG. 17.

As shown in FIG. 18, a first n-well region 21 is formed on a p-type semiconductor substrate 20, and a p-well region 22 and third n-well region 23 are formed in the first n-well region 21. In this case, a voltage of −5 V is applied to the p-type semiconductor substrate 20 and p-well region 22 and a voltage of 10 V is applied to a first n-well region 21*a* and the third n-well region 23.

Moreover, FIG. 18 illustrates maximum withstand voltages between n-type semiconductor regions (24*a*, 24*b*, and 24*c*), between p-type semiconductor regions (25*a*, 25*b*, and 25*c*), and the n-type semiconductor regions (24*a*, 24*b*, and 24*c*), p-type semiconductor regions (25*a*, 25*b*, and 25*c*), and well regions.

In the case of the switching circuit of each of the foregoing embodiments of the present invention, the p-well region 22 has a potential equal to that of the source region (24*a* in FIG. 18) of the NMOS transistors (NM1 and NM2), and the output voltage of a low-voltage amplifier circuit 272 is applied to the p-well region 22.

Moreover, the third n-well region 23 has a potential equal to that of the source region (25*a* in FIG. 18) of the PMOS transistors (PM1 and PM2), and the output voltage of a high-voltage amplifier circuit 271 is applied to the third n-well region 23.

Therefore, the switching circuit of each of the foregoing embodiments of the present invention has a disadvantage in that the latch-up phenomenon easily occurs if the output voltage {gradation voltage to be supplied to a drain signal line (D)} of the switching circuit is fluctuated due to noises or the like. However, an embodiment of the present invention makes it possible to prevent the latch-up phenomenon from easily occurring because a constant voltage is applied to the p-well region 22 and third n-well region 23.

Figure 19:
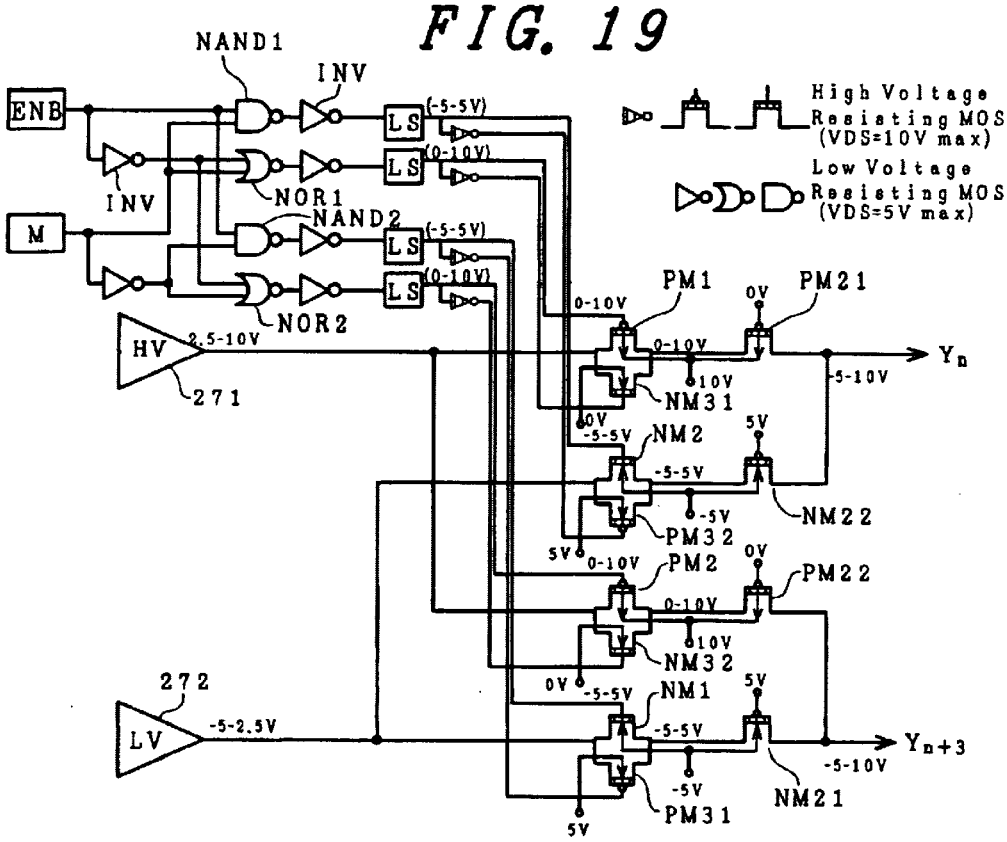
FIG. 19 is a schematic circuit diagram showing a switching circuit in the switching section (2) of an embodiment of the present invention.

FIG. 19 is a circuit diagram showing the structure of a switching circuit of the switching section (2) 264 according to an embodiment of the present invention.

This embodiment of the present invention is different from the foregoing embodiments of the present invention in that NMOS transistors (NM31 and NM32) are connected in parallel with PMOS transistors (PM1 and PM2), and PMOS transistors (PM31 and PM32) are connected in parallel with NMOS transistors (NM1 and NM2).

A voltage obtained by inverting the voltage to be applied to the gate electrodes of the PMOS transistors (PM1 and PM2) is applied to the gate electrodes of the NMOS transistors (NM31 and NM32), and the NMOS transistors (NM31 and NM32) are turned on/off synchronously with the PMOS transistors (PM1 and PM2).

Similarly, a voltage obtained by inverting the voltage to be applied to the gate electrodes of the NMOS transistors (NM1 and NM2) is applied to the gate electrodes of the PMOS transistors (PM31 and PM32), and the PMOS transistors (PM31 and PM32) are turned on/off synchronously with the NMOS transistors (NM1 and NM2).

Figure 20:
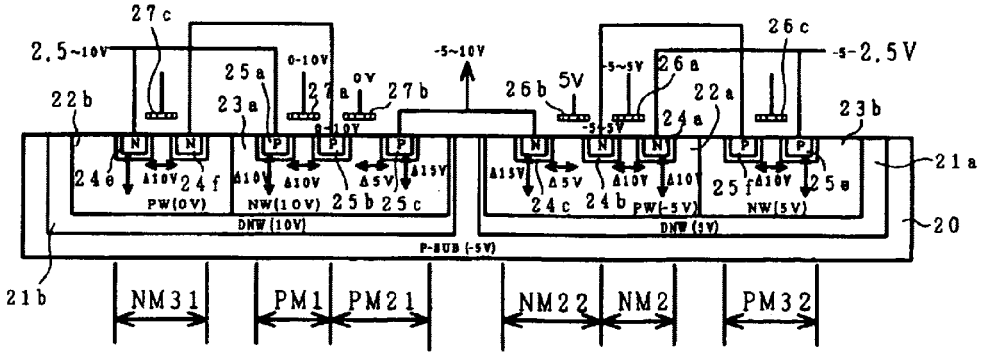
FIG. 20 is a sectional view of essential portions of the PMOS transistors (PM1, PM21, and PM32) and the NMOS transistors (NM2, NM22, and NM31) shown in FIG. 19.

FIG. 20 is a sectional view of essential portions of the PMOS transistors (PM1, PM21, and PM32) and the NMOS transistors (NM2, NM22, and NM31) shown in FIG. 19.

As shown in FIG. 20, a first n-well region 21*a* is formed on a p-type semiconductor substrate 20, and a first p-well region 22*a* and a fourth n-well region 23*b* are formed in the first n-well region 21*a*. In this case, a voltage of −5 V is applied to the p-type semiconductor substrate 20 and the first p-well region 22*a*, and a voltage of 5 V is applied to the first n-well region 21*a* and the fourth n-well region 23*b*.

A PMOS transistor (PM32) is constituted of p-type semiconductor regions (25*e* and 25*f*) formed in the fourth n-well region 23*b*, and a gate electrode (26*c*).

Similarly, a second n-well region 21*b* is formed on the p-type semiconductor substrate 20, and a third n-well region 23*a* and a second p-well region 22*b* are formed in the second n-well region 21*b*. In this case, a voltage of 10 V is applied to the second n-well region 21*b* and third n-well region 23*a*, and a voltage of 0 V is applied to the second p-well region 22*b*.

An NMOS transistor (NM31) is constituted of n-type semiconductor regions (24*e* and 24*f*) formed in the second p-well region 22*b*, and a gate electrode (27*c*).

Moreover, FIG. 20 illustrates the maximum withstand voltages between the n-type semiconductor regions (24*a*, 24*b*, 24*c*, 24*e*, and 24*f*), between the p-type semiconductor regions (25*a*, 25*b*, 25*c*, 25*e*, and 25*f*), and between the n-type semiconductor regions (24*a*, 24*b*, 24*c*, 24*e*, and 24*f*), p-type semiconductor regions (25*a*, 25*b*, 25*c*, 25*e*, and 25*f*), and well regions.

The switching circuit of each of the foregoing embodiments of the present invention makes it possible to prevent the latch-up phenomenon from easily occurring because a constant voltage is applied to the p-well region 22 and the third n-well region 23.

In the case of a MOS transistor, however, the threshold voltage ($V_T$) changes in the positive direction due to the substrate-source voltage ($V_{BS}$) (so-called substrate bias effect), thereby decreasing the drain current ($I_{DS}$), that is, increasing the on-resistance of the MOS transistor.

Moreover, each of the foregoing embodiments of the present invention has a disadvantage in that the on-resistance of a MOS transistor increases due to the substrate bias effect because the source voltages and the well voltages of the PMOS transistors (PM1 and PM2) and the NMOS transistors (NM1 and NM2) do not have the same potential.

However, an embodiment of the present invention makes it possible to prevent the on-resistance of a MOS transistor from increasing in accordance with the substrate bias effect because the PMOS transistors (PM1 and PM2) are connected in parallel with the NMOS transistors (NM31 and NM32), and the NMOS transistors (NM1 and NM2) are connected in parallel with the PMOS transistors (PM31 and PM32).

Figure 21:
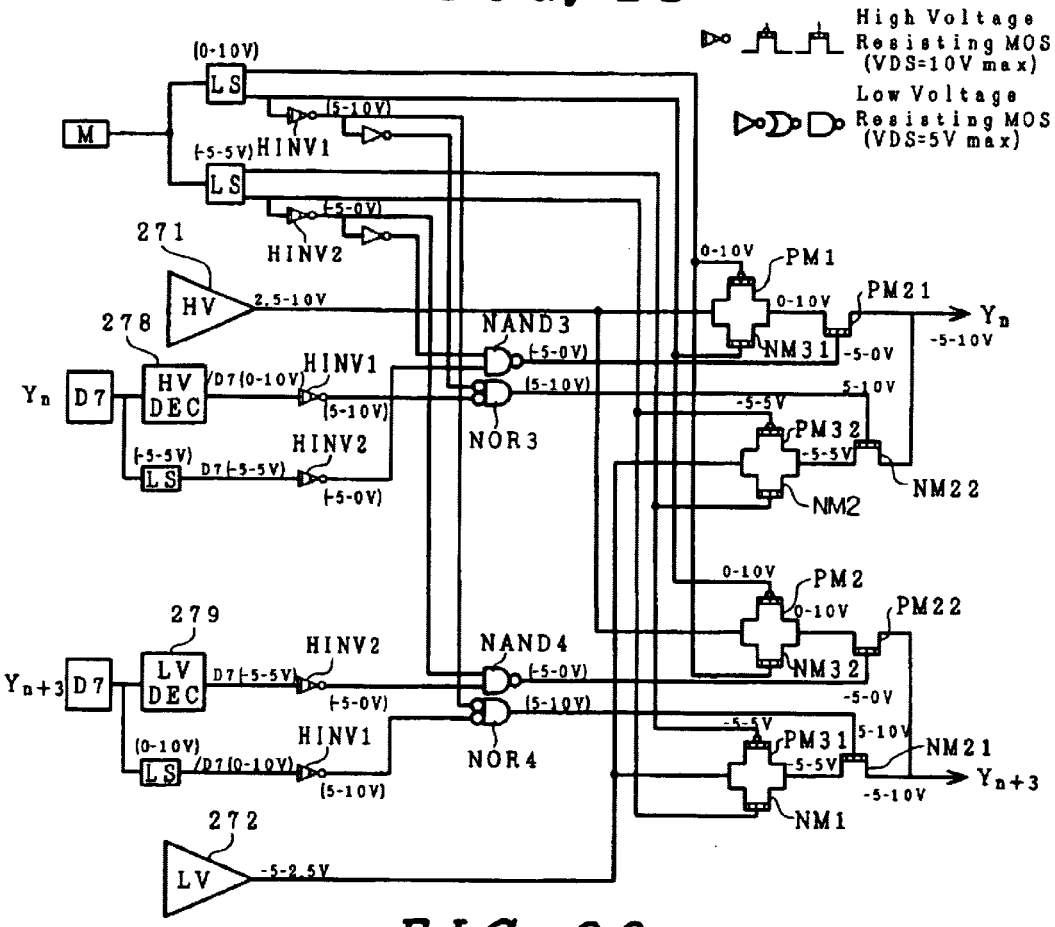
FIG. 21 is a schematic circuit diagram showing a switching circuit in the switching section (2) of an embodiment of the present invention.

FIG. 21 is a circuit diagram showing the structure of a switching circuit of the switching section (2) 264 according to an embodiment of the present invention.

This embodiment of the present invention is different from the foregoing embodiments of the present invention in that the gate voltages of the voltage-dropping MOS transistors (PM21, PM22, NM21, and NM22) connected to the MOS transistors (PM1, PM2, NM1, and NM2) in series are switched in two levels in accordance with the values of the gradation voltages outputted from the high-voltage amplifier circuit 271 and the low-voltage amplifier circuit 272.

Figure 22:
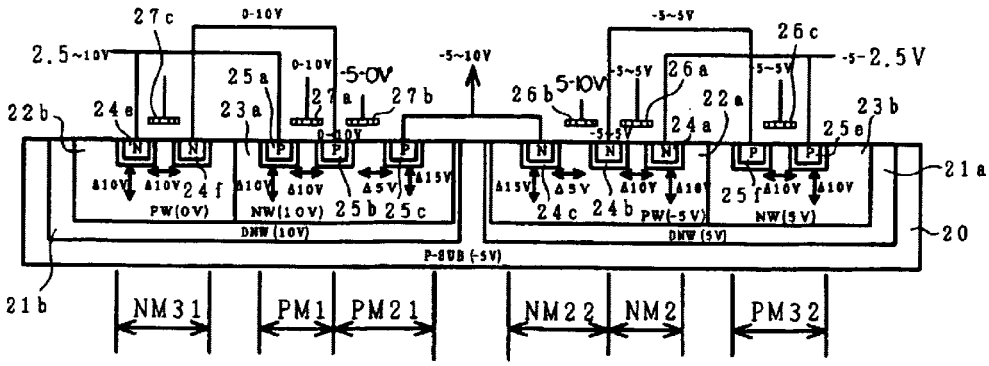
FIG. 22 is a sectional view of essential portions of the PMOS transistors (PM1, PM21, and PM32) and the NMOS transistors (NM2, NM22, and NM31) shown in FIG. 21.

FIG. 22 is a sectional view showing sectional structures of the PMOS transistors (PM1, PM2, and PM32) and the NMOS transistors (NM2, NM22, and NM31) shown in FIG. 21, which is the same as FIG. 20 except that voltages applied to the gate electrodes of the PMOS transistors (PM21 and PM22) and the NMOS transistors (NM21 and NM22) can be changed.

Tables 3 and 4 show the truth tables of the NAND circuits (NAND3 and NAND4) and the NOR circuits (NOR3 and NOR4), on/off states of the MOS transistors (PM1, PM2, PM31, PM32, NM1, NM2, NM31, and NM32), and voltage values applied to the gate electrodes of the MOS transistors (PM21, PM22, NM21, and NM22).

TABLE 3

| M | PM1/NM31 | PM2/NM32 | NM1/PM31 | NM2/PM32 |
|---|---|---|---|---|
| H | OFF | ON | OFF | ON |
| L | ON | OFF | ON | OFF |

TABLE 4

| M | D7 (Yn) | D7 (Yn+3) | NAND3 | NOR3 | NAND4 | NOR4 | PM21 | PM22 | NM21 | NM22 |
|---|---|---|---|---|---|---|---|---|---|---|
| H | H | H | H | L | H | L | 0 V | 0 V | 5 V | 5 V |
| | L | L | H | H | L | L | 0 V | −5 V | 5 V | 10 V |
| L | H | H | H | L | H | L | 0 V | 0 V | 5 V | 5 V |
| | L | L | L | L | H | H | −5 V | 0 V | 10 V | 5 V |

Moreover, in FIG. 21, inverters (HINV1 and HINV2) respectively are constituted with a MOS transistor with high withstand voltage output level-shifted output signals. That is, the inverters (HINV1 and HINV2) also serve as level shift circuits.

As shown in Table 3, when a conversion-to-AC signal (M) is H-level, the PMOS transistor (PM2) is turned on. Moreover, as shown in Table 4, a voltage of 0 V is applied to the gate electrode of the PMOS transistor (PM22) connected in series with the turned-on PMOS transistor (PM2) when the value of the most significant bit (D7) of the display data corresponding to the drain signal line (Yn+3) is H-level, and a voltage of −5 V is applied to the gate electrode of the PMOS transistor (PM22) when the value of the most significant bit (D7) of the display data corresponding to the drain signal line (Yn+3) is L-level.

Furthermore, as shown in Table 3, when the conversion-to-AC signal (M) is L-level, the PMOS transistor (PM2) is turned off. In this case, however, a voltage of 0 V is applied to the gate electrode of the PMOS transistor (PM22) independently of the value of the most significant bit (D7) of display data as shown in Table 4.

Similarly, as shown in Table 3, when the conversion-to-AC signal (M) is H-level, the NMOS transistor (NM2) is turned on. Moreover, as shown in Table 4, a voltage of 5 V is applied to the gate electrode of the NMOS transistor (NM22) connected in series with the turned-on NMOS transistor (NM2) when the value of the most significant bit (D7) of the display data corresponding to the drain signal line (Yn) is H-level, and a voltage of 10 V is applied to the gate electrode of the NMOS transistor (NM22) when the value of the most significant bit (D7) of the display data corresponding to the drain signal line (Yn) is L-level.

Furthermore, as shown in Table 3, when the conversion-to-AC signal (M) is L-level, the NMOS transistor (NM2) is turned off. In this case, however, a voltage of 5 V is applied to the gate electrode of the NMOS transistor (NM22) independently of the value of the most significant bit (D7) of the display data as shown in Table 4.

Thus, in the case of an embodiment of the present invention, when a voltage (V1in) outputted from the high-voltage amplifier circuit 271 satisfies the expression $|V1in-V1g| \leqq |V1max-V1min|/2$ (where V1max denotes the maximum voltage outputted from the high-voltage amplifier circuit 271, V1min denotes the minimum voltage outputted from the high-voltage amplifier circuit 271, and V1g denotes a bias voltage of 0 V), a voltage of −5 V is applied to the gate electrodes of the voltage-dropping PMOS transistors (PM21 and PM22) connected in series with the turned-on PMOS transistors (PM1 and PM2). Moreover, when the voltage (V1in) outputted from the high-voltage amplifier circuit 271 satisfies the expression $|V1in-V1g|>|V1max-V1min|/2$, a bias voltage of 0 V is applied to the gate electrodes of the voltage-dropping PMOS transistor (PM21 and PM22) connected in series with the turned-on PMOS transistors (PM1 and PM2).

Similarly, when a voltage (V2in) outputted from the low-voltage amplifier circuit 272 satisfies the expression $|V2in-V2g| \leqq |V2max-V2min|/2$ (where V2max denotes the maximum voltage outputted from the low-voltage amplifier circuit 272, V2min denotes the minimum voltage outputted from the low-voltage amplifier circuit 272, and V2g denotes a bias voltage of 5 V), a bias voltage of 10 V is applied to the gate electrodes of the voltage-dropping NMOS transistors (NM21 and NM2) connected in series with the turned-on NMOS transistors (NM1 and NM2). Moreover, when the voltage (V2in) outputted from the low-voltage amplifier circuit 272 satisfies the expression $|V2in-V2g|>|V2max-V2min|/2$, a bias voltage of 5 V is applied to the gate electrodes of the voltage-dropping NMOS transistors (NM21 and NM22) connected in series with the turned-on NMOS transistors (NM1 and NM2).

In general, as the gate-source voltage (VGS) decreases, the drain current ($I_{DS}$) decreases. Therefore, the on-resistance of a MOS transistor increases.

In the case of an embodiment of the present invention, however, when gradation voltages outputted from the amplifier circuits (271 and 272) are voltages close to 0 V ($|V1in-V1g| \leqq |V1max-V1min|/2$ and $|V2in-V2g| \leqq |V2max-V2min|/2$), the gate-source voltages (VGS) of the voltage-dropping MOS transistors (PM21, PM22, NM21, and NM22) connected in series with the turned-on MOS transistors (PM1, PM2, NM1, and NM2) are set so as to rise. Therefore, when gradation voltages outputted from the amplifier circuits (271 and 272) are close to 0 V, it is possible to prevent the on-resistance of a MOS transistor from increasing.

Moreover, in accordance with the present invention, it is possible to set the gate-source voltages (VGS) of the voltage-dropping MOS transistors (PM21, PM22, NM21, and NM22) connected in series with the turned-on MOS transistors (PM1, PM2, NM1, and NM2) so as to rise independently of the values of the gradation voltages outputted from the amplifier circuits (271 and 272).

Furthermore, in accordance with the present invention, it is possible to prevent the outputs of the amplifier circuits (271 and 272) from being outputted to drain signal lines (D) by an output enable signal (ENB) while scanning lines are switched similarly to the case of each of the foregoing embodiments of the present invention.

Furthermore, while there are some embodiments of the present invention whose switching circuit fabrication method has not been described, it is needless to say that the switching circuits of the foregoing embodiments can be fabricated by the above-described method.

FIGS. 23A to 23E illustrate the assembled liquid crystal display module for each of the foregoing embodiments of the present invention, showing a front view (FIG. 23A), a left side view (FIG. 23B), a right side view (FIG. 23C), a top side view (FIG. 23D), and a bottom side view (FIG. 23E) of the module as viewed from the display side of a liquid crystal display panel. FIG. 24 is an illustration of the assembled liquid crystal display module as viewed from the back side of a liquid crystal display panel.

The liquid crystal display module according to the present invention is provided with a mold case (ML) and a shield case (SHD). HLD1, HLD2, HLD3, and HLD4 denote holes formed in the mold case (ML) and shield case (SHD). The liquid crystal display module is mounted on a notebook-type personal computer by passing a screw through these four mounting holes.

An inverter circuit unit for driving a backlight is set to the recess between the mounting holes (HLD1 and HLD2) to supply a driving voltage to a cold-cathode fluorescent lamp (LP) through a linkage connector (LCT) and lamp cables (LCP1 and LCP2).

Display data, a display control signal, and power are supplied to an interface section 100 from the computer through an interface connector (CT1).

Figures 23A, 23B, 23C, 23D, 23E:
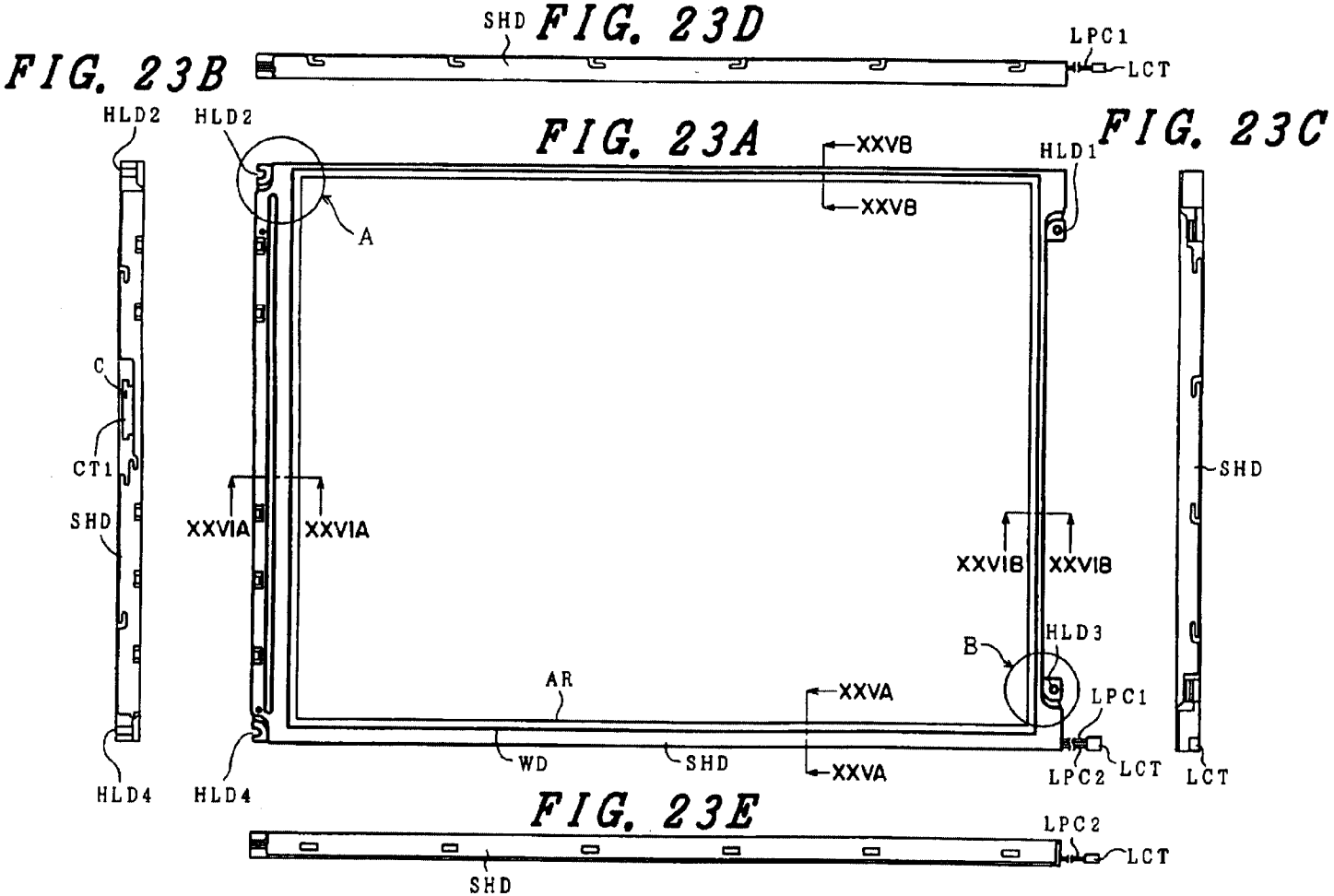
FIGS. 23A to 23E are plan views of the assembled liquid crystal display module for each of the above embodiments, in which a front view (FIG. 23A), a left side view (FIG. 23B), a right side view (FIG. 23C), a top side view (FIG. 23D), and a bottom side view (FIG. 23E) as viewed from the display surface side of a liquid crystal display panel are shown.
Figure 24:
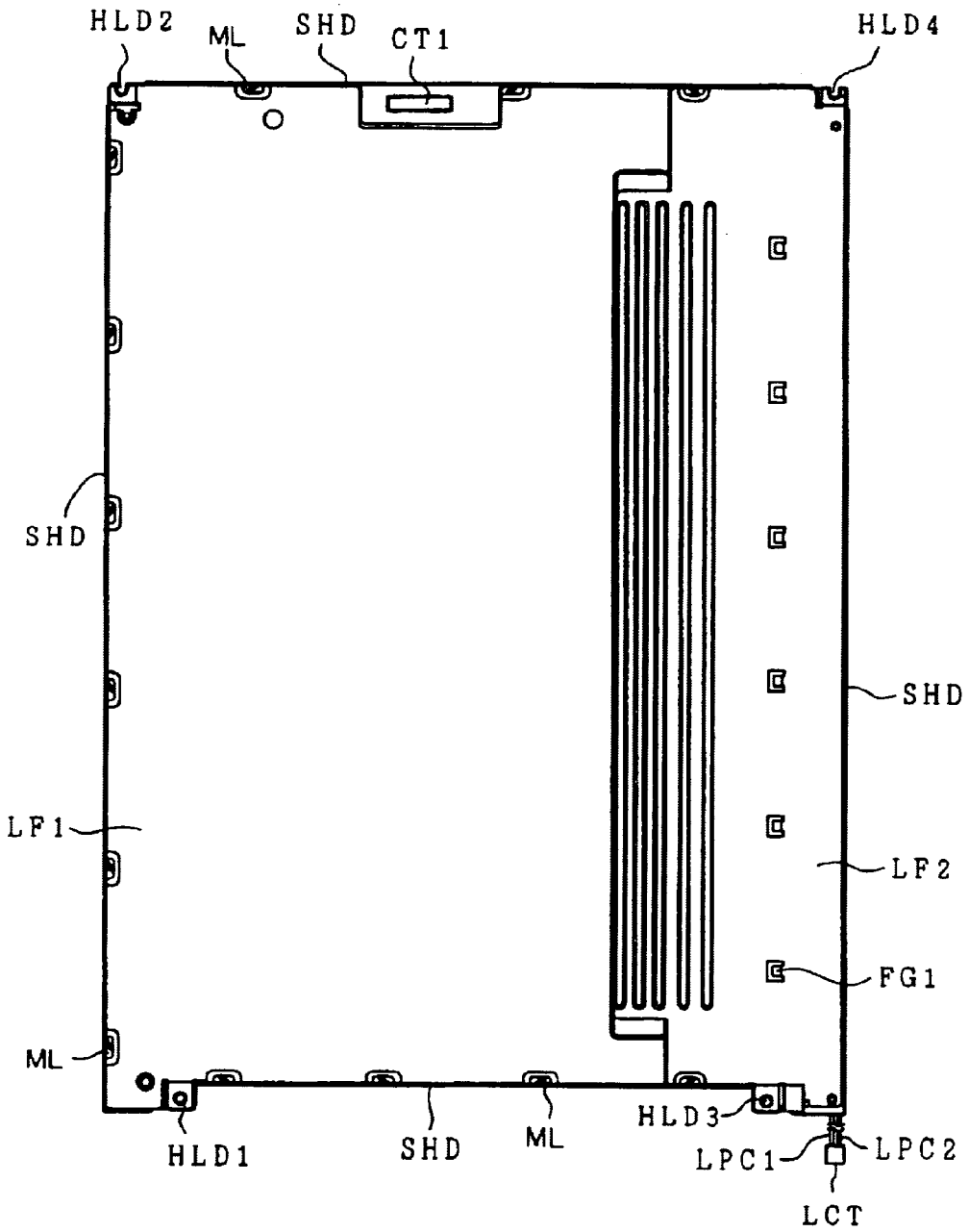
FIG. 24 is a plan view of the assembled liquid crystal display module for each of the above embodiments, viewed from the back side of a liquid crystal display panel.
Figure 25B:
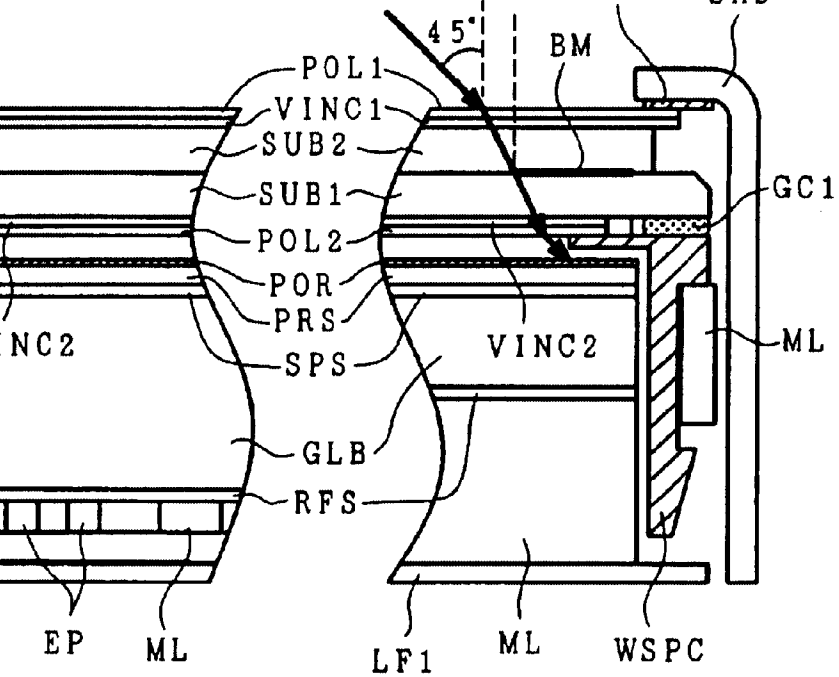
FIGS. 25A and 25B are sectional views of the assembled liquid crystal display of FIG. 23A taken along the lines XXVA—XXVA and XXVB—XXVB in FIG. 23A, respectively.
Figure 25A:
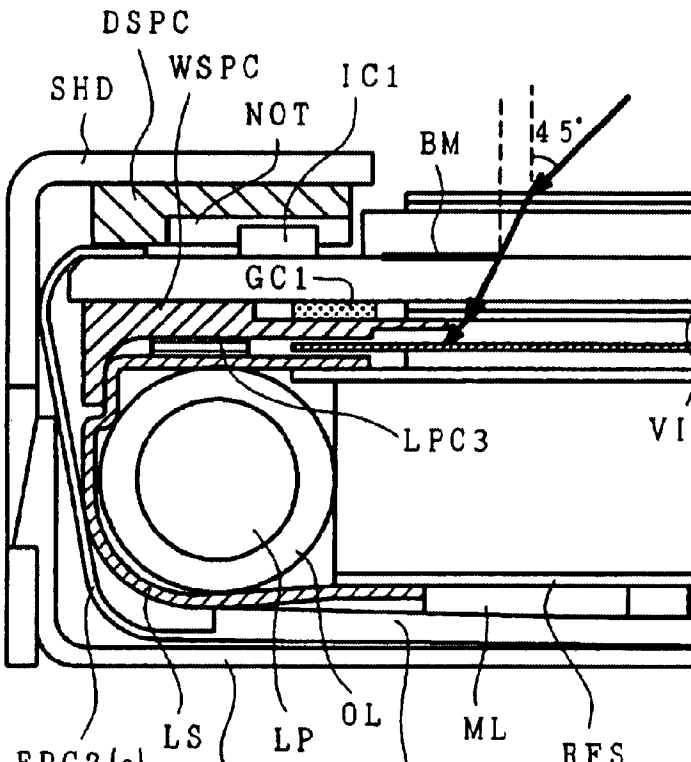
Figures 26A, 26B:
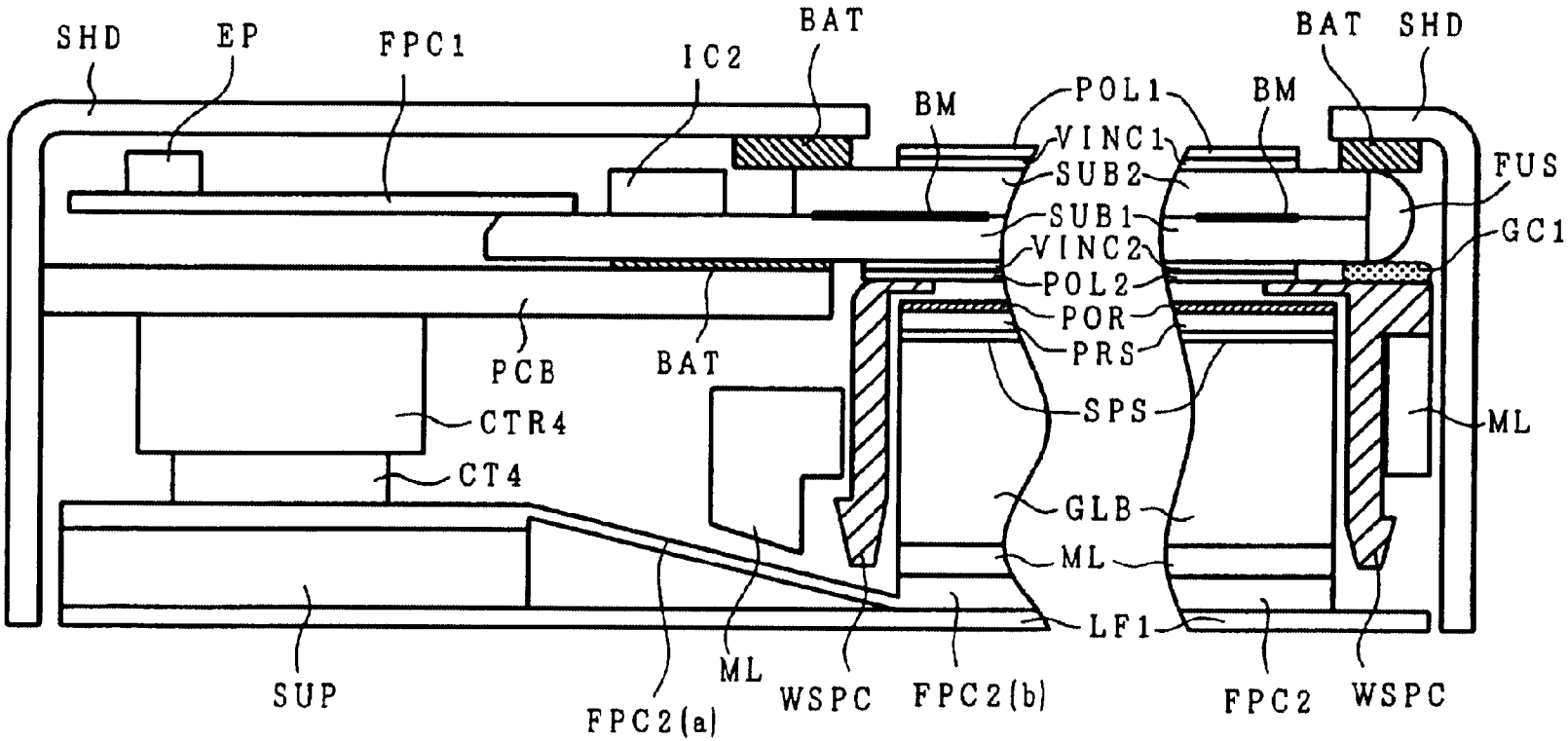
FIGS. 26A and 26B are sectional views of the assembled liquid crystal display of FIG. 23A taken along the lines XXVIA—XXVIA and XXVIB—XXVIB in FIG. 23A, respectively.

FIG. 25A is a sectional view of the liquid crystal display module in FIG. 23A taken along the line XXVA—XXVA in FIG. 23A, and FIG. 25B is a sectional view of the liquid crystal display module in FIG. 23A taken along the line XXVB—XXVB in FIG. 23A. FIG. 26A is a sectional view of the liquid crystal display module in FIG. 23A taken along the line XXVIA—XXVIA in FIG. 23A, and FIG. 26B is a sectional view of the liquid crystal display module in FIG. 23A taken along the line XXVIB—XXVIB in FIG. 23A.

In FIGS. 25A to 26B, symbol SHD denotes a shield case (upper case) for covering the circumference and the driving circuit of a liquid crystal display panel. Symbol ML denotes a mold case (lower case) for storing a backlight unit. Symbols LF1 and LF2 denote first and second lower shield cases for covering a lower case (ML).

Symbol WSPC denotes a frame spacer for covering the circumference of the backlight unit. Symbols SUB1 and SUB2 denote glass substrates constituting the liquid crystal display panel.

In FIGS. 25A to 26B, when a longitudinal electric-field-type liquid crystal display panel 10 is used, the glass substrate (SUB1) is a substrate on which a thin-film transistor (TFT) and a pixel electrode (ITO1) are formed, and the glass substrate (SUB2) is a substrate on which a color filter and a common electrode (ITO2) are formed. When a lateral electric-field-type liquid crystal display panel 10 is used, the glass substrate (SUB1) is a substrate on which a thin-film transistor (TFT), a pixel electrode (ITO1), and a facing electrode (CT) are formed, and the glass substrate (SUB2) is a substrate on which a color filter is formed.

Symbol FUS denotes a sealing material, BM denotes an opaque film formed on the glass substrate (SUB2), POL1 denotes an upper polarizing plate attached to the glass substrate (SUB2), POL2 denotes a lower polarizing plate attached to the glass substrate (SUB1), VINC1 denotes a visual-field expansion film, and VINC2 denotes a visual-field expansion film attached to the glass substrate (SUB2). The lateral electric-field-type liquid crystal display panel 10 does not always require the visual-field expansion film.

Each of the foregoing embodiments of the present invention eliminates the visual-field dependency, which is a problem peculiar to a liquid crystal display panel in which the contrast changes depending on the angle at which a user can see the display by attaching the visual-field expansion films (VINC1 and VINC2) to the glass substrates (SUB1 and SUB2).

It is possible to attach the visual-field expansion films (VINC1 and VINC2) to the outside of the polarizing plates (POLL and POL2). However, by setting the visual-field expansion films (VINC1 and VINC2) between the polarizing plates (POL1 and POL2) and the glass substrates (SUB1 and SUB2), it is possible to improve the visual-field expansion effect.

Symbol LP denotes a cold-cathode fluorescent lamp, LS denotes a lamp reflection sheet, GLB denotes a light guiding plate, RFS denotes a reflecting sheet, and SPS denotes a prism sheet. Symbol POR denotes a polarized-light reflecting plate that is used to improve the brightness of the liquid crystal display panel.

The polarized-light reflecting plate (POR) has a function for passing only the light of a specific polarization axis and reflecting the light of other polarization axes. Therefore, by adjusting the polarization axis the polarized-light reflecting plate (POR) passes to the polarization axis of the lower polarizing plate (POL2), the light having been absorbed so far by the lower polarizing plate (POL2) is changed to the polarized light passing through the lower polarizing plate (POL2) while the light reciprocates between the polarized-light reflecting plate (POR) and the light guiding plate (GLB) and is emitted from the polarized-light reflecting plate (POR). Therefore, it is possible to improve the contrast of the liquid crystal display panel.

The frame spacer (WSPC) firmly secures the light guiding plate (GLB) to the mold case (ML) by holding the circumferential portion of the light guiding plate (GLB) and inserting a hook into the holes of the mold case (ML) to prevent the light guiding plate (GLB) from colliding with the liquid crystal display panel.

Moreover, because a diffusing sheet (SPS), a prism sheet (PRS), and the polarized-light reflecting plate (POR) are held by the frame spacer (WSPC), it is possible to mount the backlight on the liquid crystal display module without distorting the diffusing sheet (SPS), the prism sheet (PRS), or the polarized-light reflecting plate (POR).

Symbol GC1 denotes a rubber cushion set between the frame spacer (WSPC) and the glass substrate (SUB1). Symbol LPC3 denotes a lamp cable for supplying a driving voltage to the cold-cathode fluorescent lamp (LP), which is made of a flat cable to minimize the mounting space and is set between the frame spacer (WSPC) and the lamp reflecting sheet (LS).

The lamp cable (LPC3) is attached to the lamp-reflecting sheet (LS) by two-sided adhesive tape. Therefore, when replacing the cold-cathode fluorescent lamp (LP), it is possible to replace the cable (LPC3) together with the lamp-reflecting sheet (LS). Thus, it is unnecessary to remove the lamp cable (LPC3) from the lamp-reflecting sheet (LS), thereby replacing the cold-cathode fluorescent lamp (LP).

Symbol OL denotes an O ring which serves as a cushion between the cold-cathode fluorescent lamp (LP) and the lamp-reflecting sheet (LS). The O ring (OL) is made of transparent synthetic resin so that the luminous brightness of the cold-cathode fluorescent lamp (LP) is not deteriorated.

Moreover, the O ring is made of an insulating material having a low permittivity in order to prevent a high-frequency current from leaking from the cold-cathode fluorescent lamp (LP). Furthermore, the O ring (OL) serves as a cushion for preventing the cold-cathode fluorescent lamp (LP) from colliding with the light guiding plate (GLB).

Symbol IC1 denotes a semiconductor chip constituting the drain driver 130 for supplying a picture signal voltage to the drain signal line (D) of the liquid crystal display panel 10, which is mounted on the glass substrate (SUB1).

Because the semiconductor chip (IC1) is mounted on only one side of the glass substrate (SUB1), it is possible to downsize the frame region of the side facing the side on which the semiconductor chip (IC1) is mounted.

Moreover, because the cold-cathode fluorescent lamp (LP) and the lamp reflecting sheet (LS) are arranged below the portion on which the semiconductor chip (IC1) of the glass substrate (SUB1) is mounted so as to be superimposed on each other, it is possible to compactly store the cold-cathode fluorescent lamp (LP) and the lamp reflecting sheet (LS) in the liquid crystal display module.

Symbol IC2 denotes a semiconductor chip constituting the gate driver 140 for supplying a scan driving voltage to the gate signal line (G) of the liquid crystal display panel 10, which is mounted on the glass substrate (SUB1).

Because the semiconductor chip (IC2) is also mounted on only one side of the glass substrate (SUB1), it is possible to downsize the frame region of the side facing the side on which the semiconductor chip (IC2) is mounted.

Symbol FPC1 denotes a flexible printed circuit board at the gate signal line side, which is connected to the external terminal of the glass substrate (SUB1) by an anisotropic conductive film to supply power and a driving signal to the semiconductor chip (IC2).

Symbol FPC2 denotes a flexible printed circuit board at the drain signal line side, which is connected to the external terminal of the glass substrate (SUB1) by an anisotropic conductive film to supply power and a driving signal to the semiconductor chip (IC1).

Chip parts (EP) such as a resistor and a capacitor are mounted on the flexible printed circuit boards (FPC1 and FPC2).

To downsize the frame region of the liquid crystal display panel 10, one portion (FPC2(*a*)) of the flexible printed circuit board (FPC2) is bent so as to wrap around the lamp reflecting sheet (LS), and another portion (FPC2(*b*)) of the flexible printed circuit board (FPC2) is secured between the mold case (ML) and the second shield case at the back of the backlight unit.

Therefore, a cutout is formed in the mold case (ML) to make room for the chip parts (EP) mounted on the flexible printed circuit board (FPC2).

The flexible printed circuit board (FPC2) is constituted by a thin portion (FPC2(*a*)) which is easily bent and a thick portion (FPC2(*b*)) for multilayer wiring.

Moreover, in the case of each of the foregoing embodiments of the present invention, a lower shield case is constituted with a first lower shield case (LF1) and a second lower shield case (LF2) so as to cover the back of the liquid crystal display module with these two lower shield cases (LF1 and LF2). Therefore, the lamp-reflecting sheet (LS) can be exposed by removing the second lower shield case (LF2). Thus, the cold-cathode fluorescent lamp (LP) can be easily replaced.

Symbol PCB denotes an interface board on which the display controller 110 and the power supply circuit 120 are mounted. The interface board (PCB) is also constituted with a multilayer printed circuit board.

In the case of each of the foregoing embodiments of the present invention, the interface board (PCB) is set under the flexible printed circuit board (FPC1) and is bonded to the glass substrate (SUB1) by two-sided adhesive tape (BAT) in order to downsize the frame region of the liquid crystal display panel 10.

As shown in FIGS, 26A, 27A, and 27B, the interface board (PCB) is provided with a connector (CTR3) and a connector (CTR4), and the connector (CTR4) is electrically connected with a connector (CT4) of the flexible printed circuit board (FPC2). Similarly, the connector (CTR3) is electrically connected with a connector (CT3) of the flexible printed circuit board (FPC1).

Figures 27A, 27B:
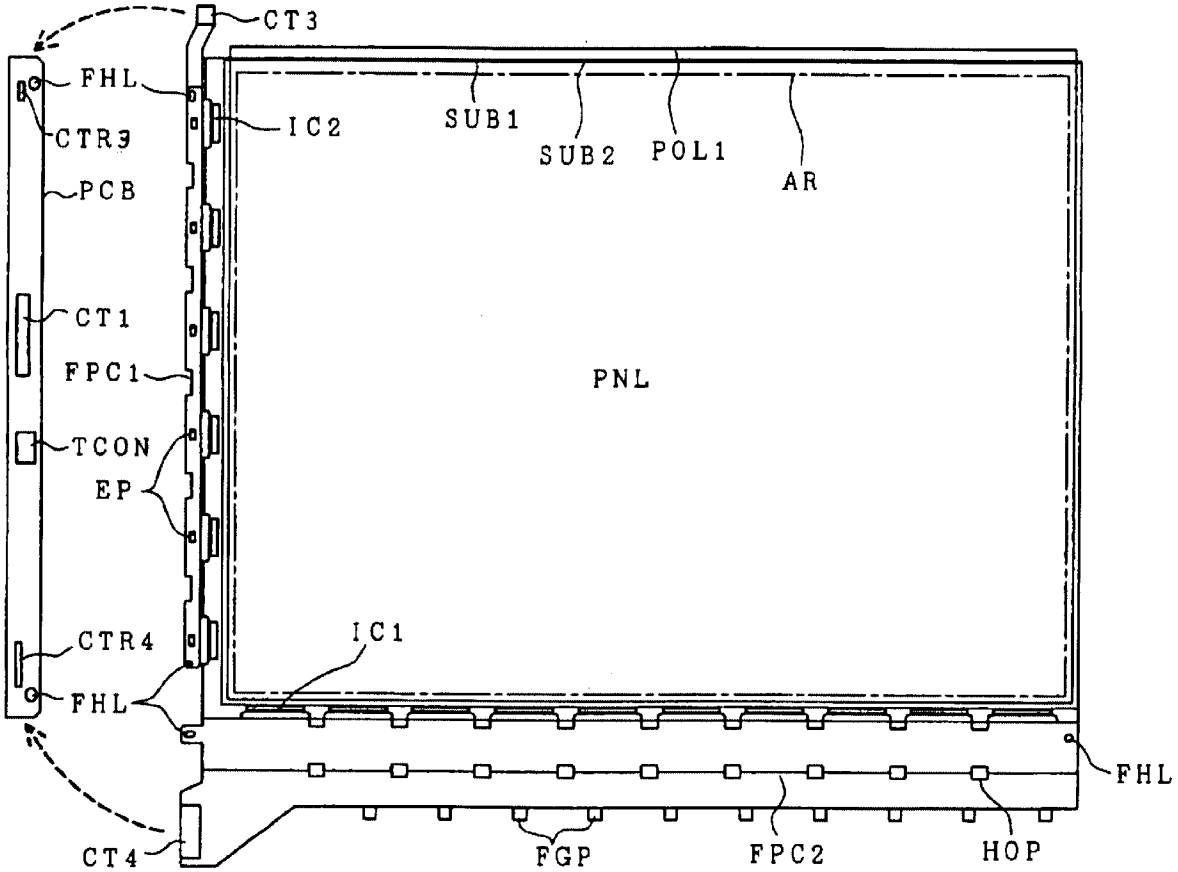
FIG. 27A is a plan view showing the state in which a flexible printed circuit board (FPC1) and a flexible printed circuit board (FPC2) before being bent are mounted around a liquid crystal display panel in the liquid crystal display module of each of the above embodiments.
FIG. 27B is a plan view showing an interface board (PCB) to which the flexible printed circuit boards (FPC1 and FPC2) are connected after being bent.

FIG. 27A shows a state in which the flexible printed circuit board (FPC1) and the flexible printed circuit board (FPC2) before being bent are mounted around the liquid crystal display panel 10, and FIG. 27B shows the interface board (PCB) to which the flexible printed circuit boards (FPC1 and FPC2) are connected after being bent.

Figure 28:
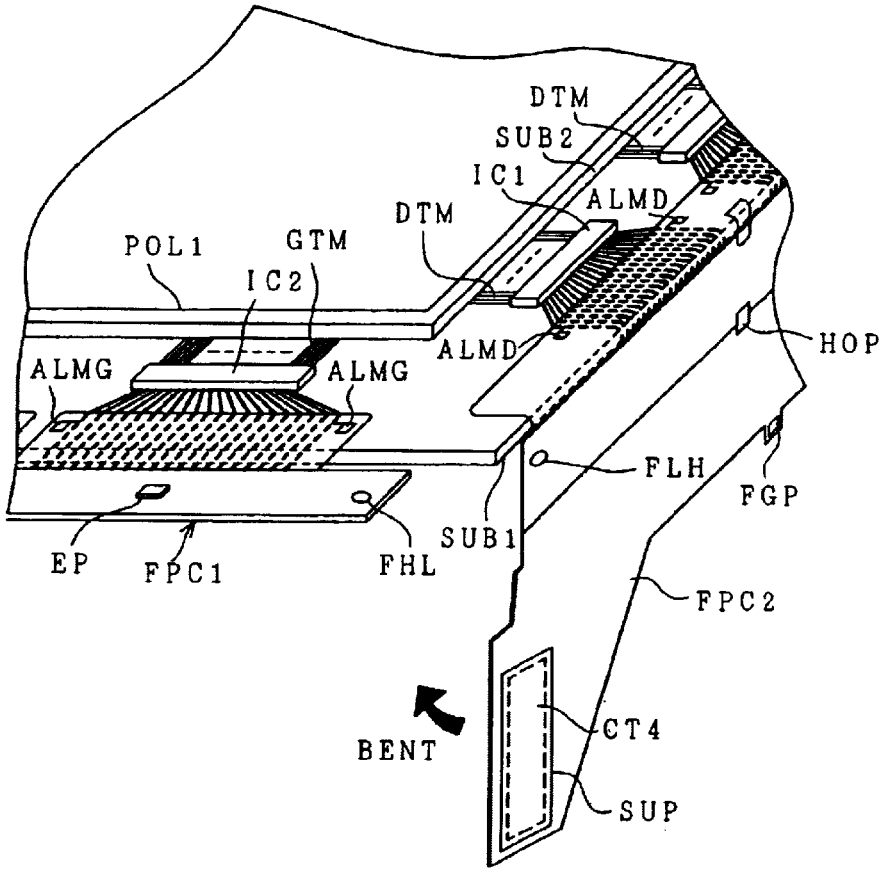
FIG. 28 is an enlarged perspective view of a portion where the liquid crystal display panel and the flexible printed circuit boards (FPC1 and FPC2) are connected to each other as shown in FIG. 27A.

FIG. 28 is an illustration showing an enlarged portion where the liquid crystal display panel 10 is connected with the flexible printed circuit boards (FPC1 and FPC2) as shown in FIG. 27A.

In FIGS. 27B and 28, symbol TCON denotes a semiconductor chip constituting the display controller 110, DTM denotes a drain terminal, and GTM denotes a gate terminal.

In FIGS. 25B, 26A, and 28, symbol SUP denotes a reinforcing plate that is set between the lower shield case (LF1) and the connector (CT4) to prevent the connector (CT4) from being removed from the connector (CTR4). Symbol SPC4 denotes a spacer set between the shield case (SHD) and the upper polarizing plate (POL1), which is made of nonwoven fabric and attached to the shield case (SHD) by an adhesive.

In the case of each of the foregoing embodiments of the present invention, the upper polarizing plate (POL1) and the visual-field expansion film (VINC1) are extended from the glass substrate (SUB2) and held by the shield case (SHD).

Each of the foregoing embodiments of the present invention can secure a large-enough strength with the above structure even if the frame region is downsized.

Symbol DSPC denotes a drain spacer that is set between the shield case (SHD) and the glass substrate (SUB1) to prevent the shield case (SHD) from colliding with the glass substrate (SUB1).

Moreover, because the drain spacer (DSPC) is set so as to cover the semiconductor chip (IC1), a cutout (NOT) is formed in the drain spacer (DSPC) to make room for the semiconductor chip (IC1).

Thereby, the shield case (SHD) or drain spacer (DSPC) does not collide with the semiconductor chip (IC1).

Furthermore, because the drain spacer (DSPC) holds the flexible printed circuit board (FPC2) on the external terminal of the glass substrate (SUB1), it prevents the flexible printed circuit board (FPC2) from being removed from the glass substrate (SUB1).

Symbol FUS denotes a sealing material for sealing the liquid crystal enclosing portion of the liquid crystal display panel.

The various features of the present invention are specifically described above in accordance with various embodiments. However, the present invention is not restricted to the foregoing embodiments of the present invention. It is a matter of course that various modifications of the present invention are allowed as long as they do not deviate from the gist of the present invention.

Advantages obtained from typical features disclosed in this application are briefly described below.

(1) According to the present invention, a semiconductor integrated circuit makes it possible to use a transistor with a low withstand voltage as the switching element of a switching circuit in which a voltage equal to or higher than the source-drain withstand voltage of the transistor with low withstand voltage is applied between the input and output terminals, and to decrease the chip size of a semiconductor chip on which the switching circuit is mounted compared to the case of using a transistor with a high withstand voltage having a source-drain withstand voltage equal to or higher than that of the transistor with a low withstand voltage.

(2) According to the present invention, a liquid crystal display makes it possible to use a transistor with low withstand voltage as the switching element of a switching section in which a voltage equal to or higher than the source-drain withstand voltage of the transistor with low withstand voltage is applied between the input and output terminals, thereby outputting a positive-polarity picture signal voltage and a negative-polarity picture signal voltage to a pair of picture signal lines and decreasing the area of the switching section in picture-signal line driving means compared to the case of using a transistor with a high withstand voltage having a source-drain withstand voltage equal to or higher than that of the transistor with a low withstand voltage as the switching element of the switching section.

(3) According to the present invention, a liquid crystal display makes it possible to decrease the chip size of picture signal driving means, thereby reducing the cost of the liquid crystal display and improving the reliability of the liquid crystal display.

What is claimed is:

1. A liquid crystal display device, comprising:

a liquid crystal display panel; and a picture signal line driving circuit for supplying a picture signal voltage to the liquid crystal display panel, the picture signal line driving circuit comprising:

a first output circuit for outputting a positive-polarity picture signal voltage, a second output circuit for outputting a negative-polarity picture signal voltage, and a switching circuit for switching the positive-polarity picture signal voltage supplied from the first output circuit and the negative-polarity picture signal voltage supplied from the second output circuit to a pair of picture signal lines and outputting the voltages, the switching circuit further including:

a first switching element connected between the first output circuit and the first picture signal line of the picture signal line pair, a third switching element connected between the first output circuit and the second picture signal line of the picture signal line pair, a second switching element connected between the second output circuit and the second picture signal line, and a fourth switching element connected between the second output circuit and the first picture signal line, wherein a positive-polarity picture signal voltage supplied from the first output circuit is output to the first or second picture signal line by selectively turning on/off the first, second, third, and fourth switching elements, wherein a negative-polarity picture signal voltage supplied from the second output circuit is output to the second or first picture signal line by selectively turning on/off the first, second, third, and fourth switching elements, and wherein the switching elements are constituted by connecting a transistor at an output circuit side to whose gate electrode a control voltage is applied in series with a transistor at a picture signal line side to whose gate electrode a constant bias voltage is applied.

2. The liquid crystal display device according to claim 1, wherein the bias voltage applied to the gate electrode of the transistor at the picture signal line side is different from the bias voltage applied to a well layer provided with a transistor at an output port and a transistor at the picture signal line side.

3. The liquid crystal display device according to claim 1, wherein the transistors at the output circuit side and the picture signal line side of the first and third switching elements are first conducting-type transistors and the transistors at the output port and the picture signal line side of the second and fourth switching elements are second conducting-type transistors, and the second conducting-type transistors are connected in parallel with the transistors at the output port of the first and third switching elements and the first conducting-type transistors are connected in parallel with the transistors at the output port of the second and fourth switching elements.

4. The liquid crystal display device according to claim 1, wherein the potential of the input terminal of the transistor at the output circuit side is equal to the potential applied to the well layer provided with the transistor at the picture signal line side.

5. A liquid crystal display device comprising:

a liquid crystal display panel; and a picture signal line driving circuit which applies a picture signal voltage to the liquid crystal display panel, the picture signal line driving circuit including a switching circuit;

wherein the switching circuit comprises:

a first transistor having an input, an output, and a gate electrode, the gate electrode of the first transistor having a control voltage applied thereto, the control voltage being effective for turning the first transistor on and off, and a second transistor having an input, an output, and a gate electrode, the gate electrode of the second transistor having a bias voltage applied thereto, the input of the second transistor being connected to the output of the first transistor so that the first transistor and the second transistor are connected in series, wherein the following relationship is satisfied in the switching circuit when the first transistor is turned off $$|V1-V2|>|V4-V3|$$

where

V1 is a maximum voltage of the output voltage of the first amplifier circuit,

V2 is a minimum voltage of the output voltage of the second amplifier circuit,

V3 is the bias voltage applied to the gate electrode of the second transistor, and

V4 is a voltage of the input of the first transistor.

6. A liquid crystal display device according to claim 5, wherein the bias voltage applied to the gate electrode of the second transistor is a first bias voltage; and wherein the first transistor and the second transistor are formed in a well layer having a second bias voltage applied thereto.

7. A liquid crystal display device according to claim 6, wherein the second bias voltage is different from the first bias voltage.

8. A liquid crystal display device according to claim 5, wherein the switching circuit further comprises a third transistor connected in parallel with the first transistor;

wherein the first transistor and the second transistor are first conducting-type transistors; and wherein the third transistor is a second conducting-type transistor.

9. A liquid crystal display device according to claim 5, wherein the first transistor and the second transistor are formed in a well layer; and wherein a voltage of the well layer is equal to a voltage of the input of the first transistor.

10. A liquid crystal display device comprising:

a liquid crystal display panel; and a picture signal line driving circuit which applies a picture signal voltage to the liquid crystal display panel, the picture signal line driving circuit including:

a first input terminal, a second input terminal, a common output terminal, a first switching circuit having an input connected to the first input terminal and an output connected to the common output terminal, and a second switching circuit having an input connected to the second input terminal and an output connected to the common output terminal;

wherein each of the first switching circuit and the second switching circuit includes:

a first transistor having an input, an output, and a gate electrode, the gate electrode of the first transistor having a control voltage applied thereto, the control voltage being effective for turning the first transistor on and off, and a second transistor having an input, an output, and a gate electrode, the gate electrode of the second transistor having a bias voltage applied thereto, the input of the first transistor being connected to the input of the switching circuit, the input of the second transistor being connected to the output of the first transistor so that the first transistor and the second transistor are connected in series, and the output of the second transistor being connected to the output of the switching circuit.

11. A liquid crystal display device according to claim 10, wherein the picture signal line driving circuit further includes a first amplifier circuit which applies an output voltage to the first input terminal, and a second amplifier circuit which applies an output voltage to the second input terminal; and wherein the following relationship is satisfied in each of the first switching circuit and the second switching circuit when the first transistor is turned off:

$$|V1-V2|>|V4-V3|$$

where

V1 is a maximum voltage of the output voltage of the first amplifier circuit,

V2 is a minimum voltage of the output voltage of the second amplifier circuit,

V3 is the bias voltage applied to the gate electrode of the second transistor, and

V4 is a voltage of the input of the first transistor.

12. A liquid crystal display device according to claim 10, wherein the bias voltage applied to the gate electrode of the second transistor is a first bias voltage; and wherein the first transistor and the second transistor are formed in a well layer having a second bias voltage applied thereto.

13. A liquid crystal display device according to claim 12, wherein the second bias voltage is different from the first bias voltage.

14. A liquid crystal display device according to claim 10, wherein each of the first switching circuit and the second switching circuit further includes a third transistor connected in parallel with the first transistor;

wherein, in the first switching circuit, the first transistor and the second transistor are first conducting-type transistors, and the third transistor is a second conducting-type transistor; and wherein, in the second switching circuit, the first transistor and the second transistor are second conducting-type transistors, and the third transistor is a first conducting-type transistor.

15. A liquid crystal display device according to claim 10, wherein the first transistor and the second transistor are formed in a well layer; and wherein a voltage of the well layer is equal to a voltage of the input of the first transistor.

16. A liquid crystal display device comprising:

a liquid crystal display panel including a first picture signal line and a second picture signal line; and a picture signal line driving circuit which applies a picture signal voltage to the liquid crystal display panel, the picture signal line driving circuit including:

a first output circuit which outputs a positive-polarity picture signal voltage, a second output circuit which outputs a negative-polarity picture signal voltage, a first switching circuit having an input connected to the first output circuit and an output connected to the first picture signal line, a second switching circuit having an input connected to the second output circuit and an output connected to the second picture signal line, a third switching circuit having an Input connected to the first output circuit and an output connected to the second picture signal line, and a fourth switching circuit having an input connected to the second output circuit and an output connected to the first picture signal line, wherein each of the first switching circuit, the second switching circuit, the third switching circuit, and the fourth switching circuit includes:

a first transistor having an input, an output, and a gate electrode, the gate electrode of the first transistor having a control voltage applied thereto, the control voltage being effective for turning the first transistor on and off, a second transistor having an input, an output, and a gate electrode, the gate electrode of the second transistor having a bias voltage applied thereto, the input of the first transistor being connected to the input of the switching circuit, the input of the second transistor being connected to the output of the first transistor so that the first transistor and the second transistor are connected in series, and the output of the second transistor being connected to the output of the switching circuit;

wherein the positive-polarity picture signal voltage output from the first output circuit is applied to the first picture signal line and the negative-polarity picture signal voltage output from the second output circuit is applied to the second picture signal line by turning on the first transistor of the first switching circuit and the first transistor of the second switching circuit, and turning off the first transistor of the third switching circuit and the first transistor of the fourth switching circuit; and wherein the positive-polarity picture signal voltage output from the first output circuit is applied to the second picture signal line and the negative-polarity picture signal voltage output from the second output circuit is applied to the first picture signal line by turning off the first transistor of the first switching circuit and the first transistor of the second switching circuit, and turning on the first transistor of the third switching circuit and the first transistor of the fourth switching circuit.

17. A liquid crystal display device according to claim 16, wherein the following relationship is satisfied in each of the first switching circuit, the second switching circuit, the third switching circuit, and the fourth switching circuit when the first transistor is turned off:

$$|V1-V2|>|V4-V3|$$

where

V1 is a maximum voltage of the output voltage of the first output circuit,

V2 is a minimum voltage of the output voltage of the second output circuit,

V3 is the bias voltage applied to the gate electrode of the second transistor, and

V4 is a voltage of the input of the first transistor.

18. A liquid crystal display device according to claim 16, wherein the bias voltage applied to the gate electrode of the second transistor is a first bias voltage; and wherein the first transistor and the second transistor are formed in a well layer having a second bias voltage applied thereto.

19. A liquid crystal display device according to claim 18, wherein the second bias voltage is different from the first bias voltage.

20. A liquid crystal display device according to claim 16, wherein each of the first switching circuit, the second switching circuit, the third switching circuit, and the fourth switching circuit further includes a third transistor connected in parallel with the first transistor;

wherein, in the first switching circuit and the third switching circuit, the first transistor and the second transistor are first conducting-type transistors, and the third transistor is a second conducting-type transistor; and wherein, in the second switching circuit and the fourth switching circuit, the first transistor and the second transistor are second conducting-type transistors, and the third transistor is a first conducting-type transistor.

21. A liquid crystal display device according to claim 16, wherein the first transistor and the second transistor are formed in a well layer; and wherein a voltage of the well layer is equal to a voltage of the input of the first transistor.

* * * * *